US007985914B2

(12) United States Patent
Ohba et al.

(10) Patent No.: US 7,985,914 B2
(45) Date of Patent: Jul. 26, 2011

(54) AUTOMATIC PLAYER ACCOMPANYING SINGER ON MUSICAL INSTRUMENT AND AUTOMATIC PLAYER MUSICAL INSTRUMENT

(75) Inventors: Yasuhiko Ohba, Hamamatsu (JP); Rei Furukawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/944,339

(22) Filed: Nov. 21, 2007

(65) Prior Publication Data

US 2008/0072743 A1 Mar. 27, 2008

Related U.S. Application Data

(63) Continuation of application No. 11/317,689, filed on Dec. 23, 2005, now abandoned.

(30) Foreign Application Priority Data

Mar. 4, 2005 (JP) ..... 2005-061303

(51) Int. Cl.
*G10H 1/36* (2006.01)

(52) U.S. Cl. ..... 84/610

(58) Field of Classification Search ..... 84/600, 84/601, 602, 603, 604, 605, 606, 609, 610, 84/611, 612, 613, 615, 616, 622, 626, 634, 84/637, 649, 650, 653, 654, 666, 669, 712, 84/723, 742, 743, 744

See application file for complete search history.

(56) References Cited

U.S. PATENT DOCUMENTS

| | | | | |
|---|---|---|---|---|
| 4,970,928 | A * | 11/1990 | Tamaki | 84/21 |
| 5,142,961 | A * | 9/1992 | Paroutaud | 84/726 |
| 5,455,378 | A * | 10/1995 | Paulson et al. | 84/610 |
| 6,525,255 | B1 | 2/2003 | Funaki | |
| 2001/0037196 | A1 * | 11/2001 | Iwamoto | 704/207 |
| 2002/0059862 | A1 * | 5/2002 | Muramatsu et al. | 84/719 |
| 2006/0196346 | A1 | 9/2006 | Ohba et al. | |

FOREIGN PATENT DOCUMENTS

| | | |
|---|---|---|
| JP | 7319457 | 12/1995 |
| JP | 8335079 | 12/1996 |
| JP | 2002-091291 | 3/2002 |
| JP | 2004-355015 | 12/2004 |

OTHER PUBLICATIONS

Japanese Office Action mailed Feb. 10, 2009, regarding JP Application No. JP2005-061303.

* cited by examiner

*Primary Examiner* — Jeffrey Donels
*Assistant Examiner* — Andrew R Millikin
(74) *Attorney, Agent, or Firm* — Morrison & Foerster LLP

(57) ABSTRACT

An automatic player piano includes a voice recognizer and a piano controller; while a user is singing a song, the voice recognizer analyzes the voice signal representative of vocal tones so as to determine the loudness and pitch of each vocal tone, and successively sends music data codes each expressing a note-on event, key number closest to the pitch of vocal tone and a velocity and music data codes each expressing a note-off and the key number to the piano controller together with music data codes duplicated from a set of music data codes stored in the memory; and the piano controller selectively drives the black and white keys with driving signal produced on the basis of the music data codes so as to play the accompaniment of the song.

18 Claims, 12 Drawing Sheets

AUTOMATIC PLAYER ACCOMPANYING SINGER ON MUSICAL INSTRUMENT AND AUTOMATIC PLAYER MUSICAL INSTRUMENT

CROSS-REFERENCE TO RELATED APPLICATIONS

This application is a continuation of U.S. patent application Ser. No. 11/317,689 filed Dec. 23, 2005, the entire disclosure of which is incorporated herein by reference.

FIELD OF THE INVENTION

This invention relates to an automatic player and an automatic player musical instrument for producing tones along a music passage without any fingering of a human player.

DESCRIPTION OF THE RELATED ART

A "karaoke" is popular with music fans. The karaoke accompanies a singer on the electric or electronic tone generator, which produces instrumental tones along a music passage, and produces words on the display panel. In other words, a singer sings a song to the accompaniment of the karaoke. The instrumental tones are independent of the human voice, and the singer needs to control his or her pronunciation.

A prior art karaoke recognizes voice tones of a singer, and electronically produces voice tones for the harmony. A typical example of the prior art karaoke is disclosed in Japanese Patent Application laid-open No. Hei 8-234771. The prior art karaoke disclosed in the Japanese Patent Application laid-open picks up the human voice through a microphone, and analyzes the digital signal, which is converted from the analog signal produced in the microphone, so as to determine the pitch of tones. The prior art karaoke converts the pitch of tones from the detected values to certain values for the harmony, and produces a digital signal representative of the electronic voice tones. The digital signal representative of the electronic voice tones is mixed with the digital signal representative of the human voice tones, and the digital mixed signal is output therefrom. However, the electronic human voice can not satisfy music fans who have ears for music.

An automatic player piano is available for the accompaniment. The automatic player piano is a combination of an acoustic piano and an automatic player. The automatic player analyzes pieces of music data stored in music data codes, and selectively gives rise to the key motion in the acoustic piano without any fingering of a human player. The acoustic piano tones satisfy the music fans. However, it is necessary for the singer to prepare a set of music data codes expressing a part of a music passage for the accompaniment. In case where the set of music data codes is not sold in the market, the singer must record his or her performance along the part of the music passage through the automatic player piano with built-in recording system. Moreover, the playback through the automatic player piano is independent of the principal melody song by the singer. Even if the singer wishes to change the tempo for his or her artistic expression, the automatic player piano keeps the accompaniment at the original tempo. Thus, there is a trade-off between the accompaniment of the prior art karaoke and the accompaniment of the automatic player piano.

SUMMARY OF THE INVENTION

It is therefore an important object of the present invention to provide an automatic player, which plays a part of a music passage on an acoustic musical instrument in good harmony with a singer.

It is also an important object of the present invention to provide an automatic player musical instrument, in which the automatic player is incorporated.

To accomplish the object, the present invention proposes to drive an acoustic musical instrument with pieces of music data expressing pitches of internal sound related to intended pitches of external sound determined through a sound recognition.

In accordance with one aspect of the present invention, there is provided an automatic player for playing a part of a piece of music on an acoustic musical instrument comprising a sound recognizer analyzing at least pitches of external sound produced outside of the acoustic musical instrument, determining intended pitches on the basis of the pitches of the external sound and producing pieces of music data expressing at least pitches of internal sound related to the intended pitches of the external sound, plural actuators associated with manipulators of the acoustic musical instrument and responsive to driving signals so as independently to drive the associated manipulators for producing the internal sound at given pitches without any action of a human player, and a controller connected to the sound recognizer and the plural actuators, and supplying the driving signals to the actuators associated with the manipulators to be driven for producing the internal sound at the pitches expressed by the pieces of music data.

In accordance with another aspect of the present invention, there is provided an automatic player musical instrument for playing at least a part of a piece of music comprising an acoustic musical instrument including manipulators driven for specifying pitches of internal sound and a tone generator connected to the manipulators and producing the internal sound at the pitched specified through the manipulators, and an automatic player provided in association with the acoustic musical instrument and including a sound recognizer analyzing at least pitches of external sound produced outside of the acoustic musical instrument, determining at least intended pitches on the basis of the pitches of the external sound and producing pieces of music data expressing at least pitches of the internal sound related to the intended pitches for playing the part of the piece of music, plural actuators associated with the manipulators and responsive to driving signals so as independently to move the associated manipulators, thereby causing the tone generator to produce the internal sound without any action of a human player and a controller connected to the sound recognizer and the plural actuators and supplying the driving signals to the actuators associated with the manipulators to be driven for producing the internal sound at the pitches expressed by the pieces of music data.

BRIEF DESCRIPTION OF THE DRAWINGS

The features and advantages of the automatic player and automatic player musical instrument will be more clearly understood from the following description taken in conjunction with the accompanying drawings, in which.

DESCRIPTION OF THE PREFERRED EMBODIMENTS

Figure 1:
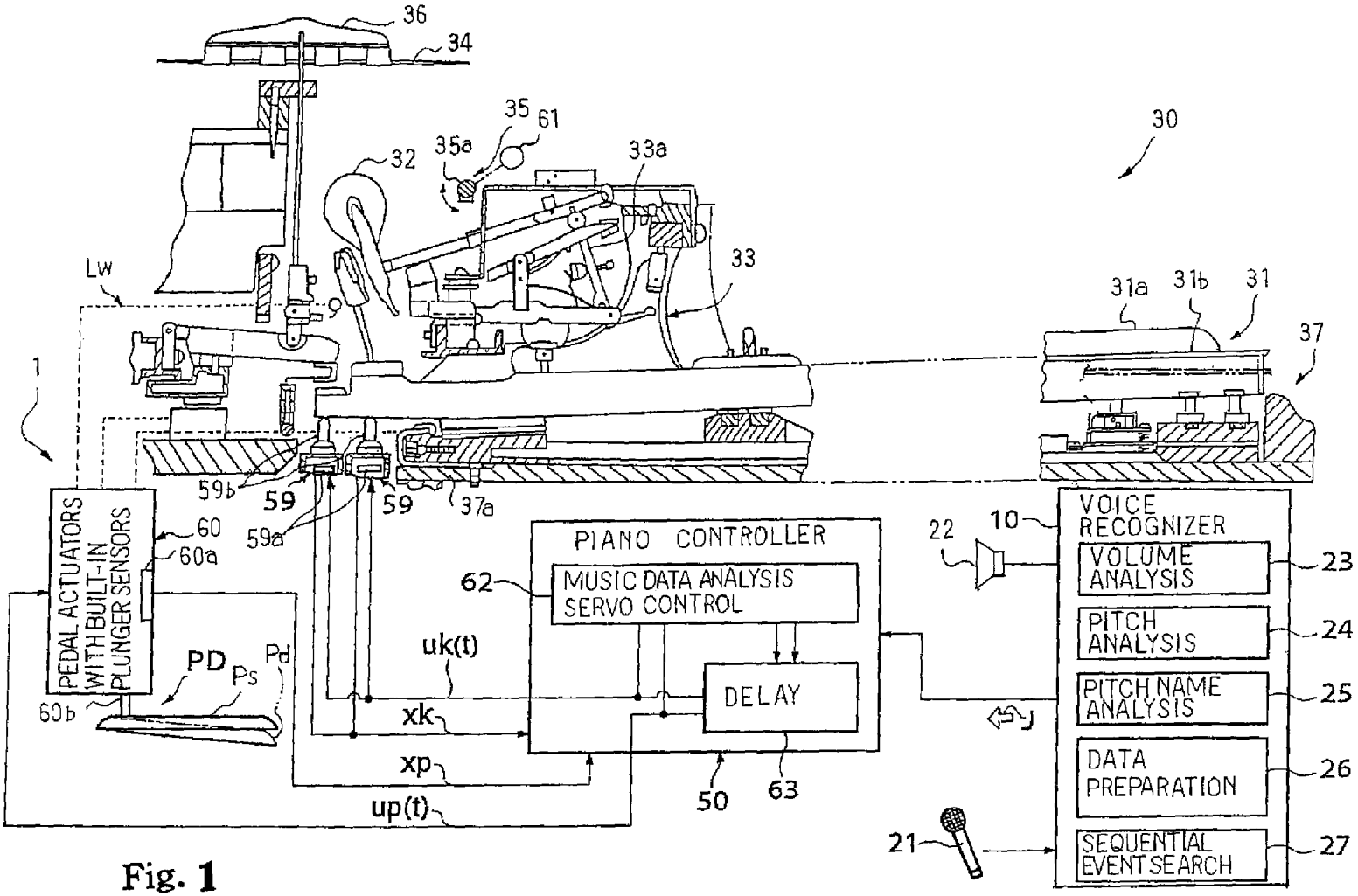
FIG. 1 is a side view showing the structure of an automatic player piano according to the present invention.

An automatic player musical instrument embodying the present invention largely comprises an acoustic musical instrument and an automatic player. The automatic player plays pieces of music on the acoustic musical instrument without any fingering of a human player. When a user instructs the automatic player to accompany his or her song on the acoustic musical instrument, the automatic player analyzes pitches of vocal tones in an external sound represented by an audio signal, and supplies pieces of music data expressing pitches of tones contained in an internal sound for playing the accompaniment.

The acoustic musical instrument includes manipulators and a tone generator connected to the manipulators. A human player or the automatic player selectively drives the manipulators so that the tone generator produces the tones at the pitches specified by the player through the manipulators. The automatic player includes a sound recognizer plural actuators and a controller. The controller is connected to the sound recognizer and plural actuators, and the plural actuators are associated with the manipulators so as selectively to drive the manipulators for specifying the pitches of the tones to be produced.

When a singer starts to sing a song, the vocal tones are successively converted to the audio signal, and the audio signal is supplied to the sound recognizer. The sound recognizer determines the pitch and loudness of each tone through the analysis on the audio signal, and presumes the pitch of the tone intended by the singer because the singer sometimes unintentionally pronounces the tone at a pitch slightly different from the pitch of the note on the music score.

Subsequently, the sound recognizer determines the pitches of the tones to be produced for the accompaniment. The pitches of the tones to be produced may be identical with the intended pitches of the vocal tones. In case where the singer instructs the automatic player to produce a series of chords for the accompaniment, the sound recognizer determines the pitches of the tones forming each chord. The sound recognizer produces pieces of music data expressing the tones to be produced for the accompaniment, and supplies the pieces of music data to the controller.

The controller specifies the manipulators to be driven for producing the tones, and supplies driving signals to the actuators associated with the manipulators to be driven. The actuators are energized with the driving signals, and give rise to motion of the associated manipulators. As a result, the tone generator produces the tones at the pitches for the accompaniment.

As will be understood, the automatic player according to the present invention accompanies the singer on the acoustic musical instrument so that the singer can practice songs as if he or she stands on a stage in a concert hall.

In the following description, term "front" is indicative of a position closer to a player, who is sitting for fingering, than a position modified with term "rear". A line drawn between a front position and a corresponding rear position extends in "fore-and-aft direction", and "lateral direction" crosses the fore-and-aft direction at right angle. "Up-and-down" direction is normal to a plane defined by the fore-and-aft direction and lateral direction. Component parts are staying at respective "rest positions" without any external force, and reach respective "end positions" at the end of the motion.

First Embodiment

Referring to FIG. 1 of the drawings, an automatic player piano embodying the present invention largely comprises an automatic player 1, an acoustic piano 30 and a mute system 35. Although a recording system is further incorporated in the automatic player piano, the recording system is well known to persons skilled in the art, and no further description is hereinbefore incorporated for the sake of simplicity.

The automatic player 1 is installed in the acoustic piano 30, and performs a piece of music on the acoustic piano 30 without any fingering of a human player. The automatic player 1 is responsive to pieces of music data stored in a set of music data codes so as to reenact an original performance on the acoustic piano 30 as similar to the prior art automatic player. In this instance, the formats of the music data codes are defined in the MIDI (Musical Instrument Digital Interface) protocols.

The automatic player 1 according to the present invention recognizes human voice pronounced along a music passage, and determines the tones to be produced for the accompaniment. The attributes of human voice recognized by the automatic player 1 are at least the pitch and loudness so that the automatic player can determine the note number and velocity for the tones to be produced through the acoustic piano. The automatic player 1 produces MIDI music data codes expressing the tones to be produced, and drives the acoustic piano 30 to produce the tones for the accompaniment. Thus, the automatic player 1 timely produces the tones for the accompaniment through the data processing on the human voice in real time fashion.

The mute system 35 includes a hammer stopper 35*a* and an electric motor 61, and the hammer stopper 35*a* is changed between a free position and a blocking position by means of the electric motor 61. While the hammer stopper 35*a* is staying at the free position, the hammer stopper 35*a* is not an obstacle against the hammer motion so that the acoustic piano 30 gives rise to the acoustic tones as usual. When the hammer stopper 35*a* is changed to the blocking position, the hammer stopper 35*a* is moved into the hammer trajectories so as to interrupt the hammer motion before strikes. Thus, any acoustic tone is not produced in the acoustic piano 30 at the blocking position.

Acoustic Piano

The acoustic piano 30 comprises a keyboard 31, which includes black keys 31*a* and white keys 31*b*, hammers 32, action units 33, strings 34, dampers 36, a piano cabinet 37 and a pedal system PD. The black keys 31*a* and white keys 31*b* are laterally arranged, and are laid on the well-known pattern. In this instance, eighty-eight keys 31*a*/31*b* form the well-known pattern. The keyboard 31 is mounted on a front portion of the piano cabinet 37, and is exposed to a human player. The action units 33, hammers 32, strings 34 and dampers 37 are housed in the piano cabinet 37, and are exposed to the environment through an upper opening of the piano cabinet, which is opened and closed with a top board (not shown).

The action units 33 are provided over the rear portion of the black and white keys 31*a*/31*b*, and are respectively linked with the associated black and white keys 31*a*/31*b*. For this reason, the action units 33 are actuated by the associated black and white keys 31*a*/31*b* independently of one another. The hammers 32 are held in contact with jacks 33*a*, which form parts of the action units 33, and are driven for rotation by the actuated action units 33 in the space over the action units 33.

The strings 34 are stretched over the hammers 32, and the hammers 32 are brought into collision with the associated strings 34 at the end of the rotation. Then, the strings 34 vibrate, and the acoustic piano tones are produced through the vibrating strings 34. However, white the hammer stopper 35*a* is staying at the blocking position, the hammers 32 rebound on the hammer stopper 35*a* before the strike at the strings 34. Thus, the hammer stopper 35*a* prevents the strings 34 from the strikes with the hammers 32, and does not permit the strings 34 to produce the acoustic piano tones.

The dampers 36 are linked at the lower ends thereof with the rear portions of the black and white keys 31*a*/31*b*. While the black and white keys 31*a*/31*b* are staying at the rest positions, the dampers 36 are held in contact with the strings 34, and prohibit the strings 34 from resonance with other vibrating strings 34. When a player starts to depress the black and white keys 31*a*/31*b*, the front portions of the depressed keys 31*a*/31*b* begin the downward motion. The rear portions of black and white keys 31*a*/31*b* give rise to upward motion of the dampers 36, and make the dampers 36 spaced from the strings 34. Thus, the dampers 36 permit the strings 34 to vibrate at intermediate points on the key trajectories of the associated black and white keys 31*a*/31*b*.

The pedal system PD includes a damper pedal Pd, a soft pedal Ps, a sostenuto pedal (not shown) and linkwork Lw for these pedals Ps/Ps. As well known to the persons skilled in the art, the damper pedal Pd makes the acoustic piano tones prolonged by keeping the dampers 36 spaced, and the soft pedal Ps makes the volume of piano tones small by lessening the number of strings struck with the hammers 32.

While a human player is fingering a piece of music on the keyboard 31, the depressed keys 31*a*/31*b* cause the associated action units 33 actuated, and the actuated action units 33 make the associated hammers 32 driven for rotation so that the strings 34 are struck with the hammers 32 at the end of the rotation. The vibrating strings 34 produce the acoustic piano tones along the piece of music. Thus, the acoustic piano 30 behaves as those well known to the persons skilled in the art.

Automatic Player

The automatic player 1 includes a voice recognizer 10, a microphone 21, a sound system 22, a piano controller 50, solenoid-operated key actuators 59 with built-in plunger sensors 59*a*, solenoid-operated pedal actuators 60 with built-in plunger sensors 60*a*. The piano controller 50 has a data processing capability for the accompaniment as well as the automatic playing, and the voice recognizer 11 has a data processing capability for a voice recognition on songs.

The piano controller 50 is connected to the solenoid-operated key actuators 59, built-in plunger sensors 59*a*, solenoid-operated pedal actuators 60 and built-in plunger sensors 60*a*. The piano controller 50 form a servo control loop together with the solenoid-operated key actuators 59 and built-in plunger sensors 59*a* for the black and white keys 31*a*/31*b*, and another servo control loop together with the solenoid-operated pedal actuators 60 and built-in plunger sensors 60*a*.

The voice recognizer 10 is connected to the microphone 21, sound system 22 and piano controller 50. The microphone 21 converts human voices, which express songs, to a voice signal, and the voice signal is supplied through an amplifier (not shown) to the voice recognizer 10. The voice recognizer 10 analyzes the voice, and determines the vocal tones to be produced for the accompaniment. The voice recognizer 10 stores the pieces of music data expressing the vocal tones in the music data codes, and supplies the music data codes to the piano controller 50 together with the music data codes duplicated from the set of music data codes expressing the piece of music. The voice recognizer 10 supplies the voice signal to the sound system 22. As a result, the song is radiated from the sound system 22 synchronously with the accompaniment.

The solenoid-operated key actuators 59 are hung from a key bed 37*a*, and have respective plungers 59*b*, the tips of which are in the proximity of the lower surfaces of the rear portions of the associated black and white keys 31*a*/31*b* at the rest positions. When the piano controller 50 energizes the solenoid-operated key actuators 59 with driving signals uk(t), the plungers 59*b* start to upwardly project so as to push the rear portions of the black and white keys 31*a*/31*b*. When the driving signals uk(t) are removed from the solenoid-operated key actuators 59, the self-weight of the action units 33 causes the black and white keys 31*a*/31*b* to return to the rest positions. Thus, the black and white keys 31*a*/31*b* are fingered with the solenoid-operated key actuators 59 instead of a human player. The built-in plunger sensors 59*a* monitor the plungers 59*b*, and produce plunger position signals xk representative of current plunger positions, which are equivalent to current key positions.

The solenoid-operated pedal actuators 60 are provided between the three pedals Pd/Ps and the linkwork Lw, and have respective plungers 60*b*, the tips of which are in the proximity of the upper surfaces of the three pedals Pd/Ps. When the piano controller 50 energizes the three pedals Pd/Ps with driving signals up(t), the plungers 60*b* start to downwardly project, and push down the pedals Pd/Ps. Since return springs (not shown) are provided in association with the plungers 60*b*, the plungers 60*b* return to their rest positions in the absence of the driving signals up(t). The built-in plunger sensors 60*a* monitor the associated pedals Pd/Ps, and produce plunger position signals xp representative of the current plunger positions, which are equivalent to the pedal stroke from the rest positions. Thus, the three pedals Pd/Ps are depressed with the solenoid-operated pedal actuators 60 instead of a human player.

Figure 2:
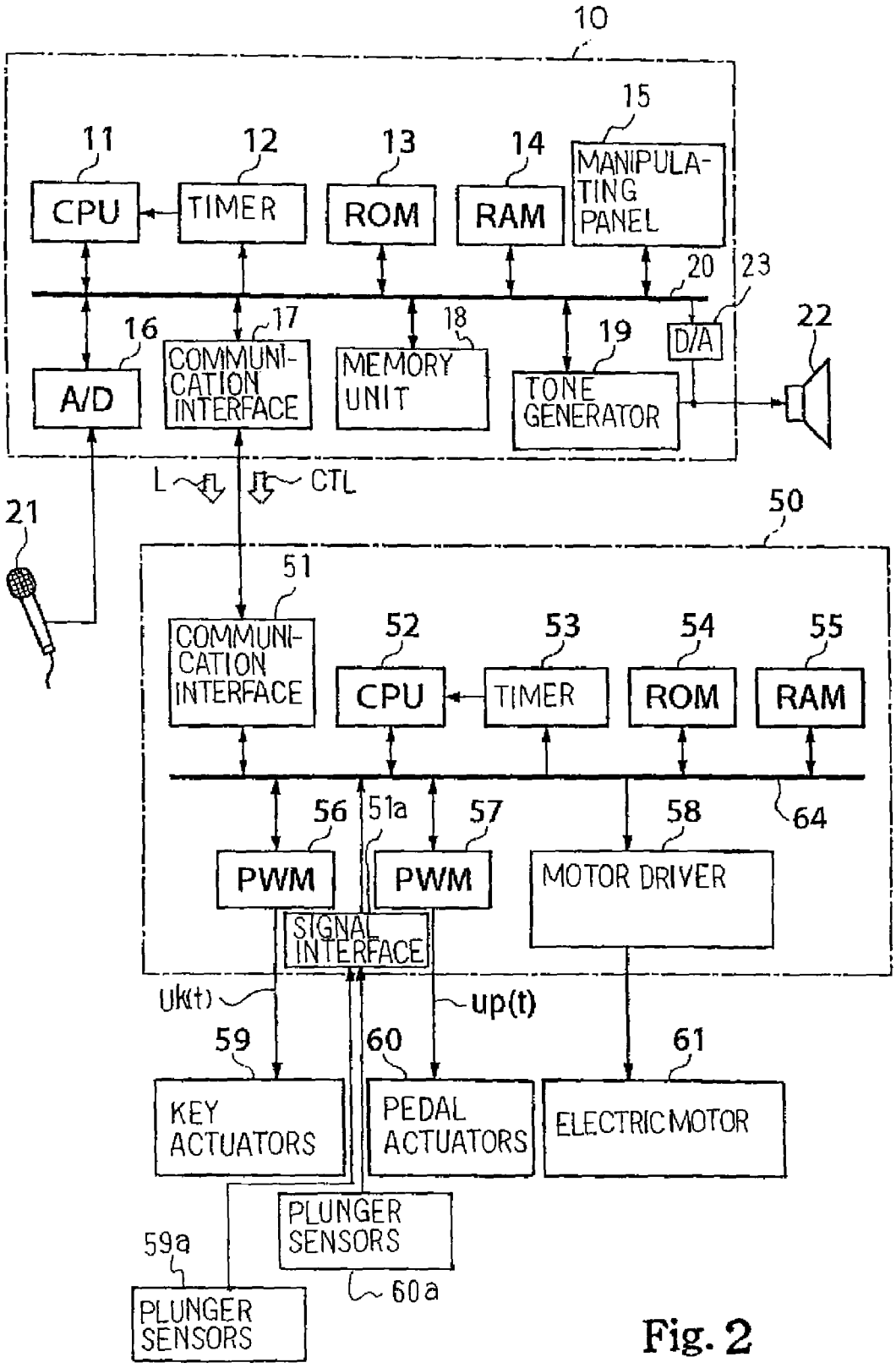
FIG. 2 is a block diagram showing the system configuration of an automatic player incorporated in the automatic player piano.

Turning to FIG. 2 of the drawings, the voice recognizer 10 includes a central processing unit 11, which is abbreviated as "CPU", a timer 12, a read only memory 13, which is abbreviated as "ROM", a random access memory 14, which is abbreviated as "RAM", a manipulating panel 15, a signal interface, which has an analog-to-digital converter 16 for the microphone 21, a communication interface 17, a memory unit 18, a tone generator 19, a digital-to-analog converter 23 and a shared bus system 20. The system components 11, 12, 13, 14, 15, 16, 17, 18, 19 and 23 are connected to the shared bus system 20 so that the central processing unit 11 is communicable with the other system components 11 to 19 and 23 through the shared bus system 20. The tone generator 19 is connected to the sound system 22, and an audio signal is converted to electronic tones through the sound system 22.

The central processing unit 11 is the origin of the data processing capability of the voice recognizer 10, and sequentially executes instruction codes so as to achieve given tasks.

The instruction codes form a computer program, which runs on the central processing unit 11, and are stored in the read only memory 13. Other parameters, which are read out during the data processing for the voice recognition, are also stored in the read only memory 13.

The computer program is broken down into a main routine program and subroutine programs. When a user energizes the voice recognizer 10, the central processing unit 11 starts sequentially to execute the instruction codes of the main routine program, and firstly initializes the voice recognizer 10. While the central processing unit 11 is reiterating the main routine program, users are communicable with the central processing unit 11, and gives user's instructions to the central processing unit 11. One of the subroutine programs is assigned to the voice recognition, and another subroutine program is assigned to the data fetch from the analog-to-digital converter 16. The main routine program periodically selectively branches to these subroutine programs through timer interruptions. Thus, the central processing unit 11 obtains the pieces of voice data, analyzes the voice data, produces the pieces of music data and transfers the music data to the piano controller 50.

The random access memory 14 offers a large amount of addressable memory locations, which serve as temporary data storages, flags and registers, to the central processing unit 11. Piece of voice data, pieces of analyzed data and pieces of music data, which express electronic tones to be reproduced for an accompaniment, are memorized in the temporary data storages. Several flags are assigned to user's instructions.

The timer 12 measures the lapse of time from the initiation of the voice recognition and time intervals for timer interruptions. While the subroutine program is running on the central processing unit 11 for the voice recognition, the timer interruption periodically takes place, and the central processing unit 11 fetches the pieces of voice data from the analog-to-digital converter 16. The pieces of voice data are memorized in the temporary data storage in the random access memory 14.

Various switches, keys, indicators and a display window are arranged on the manipulating panel 15 for the communication between users and the central processing unit 11. The users give their instructions to the central processing unit 11 through the switches and keys. The users also give their instructions to the piano controller 50 through the manipulating panel 15, and the central processing unit 11 transfers the user's instructions through the communication interface 17 to the piano controller 50. The central processing unit 11 reports the current status to the users through the indicators and display window, and delivers prompt messages to the users through the display window.

The analog-to-digital converter 16 periodically samples discrete values on the voice signal, and converts the discrete values to the voice data codes. As described hereinbefore in conjunction with the random access memory 14, the voice data codes are stored in the temporary data storage, and, thereafter, analyzed by the central processing unit 11.

The voice recognizer 10 is connected to the piano controller 50 through the communication interface 16, and the pieces of music data J, which express the electric tones to be produced for an accompaniment, and pieces of control data CTL, which express the user's instruction and tasks to be achieved inside the piano controller 50, are transferred from the central processing unit 11 through the communication interface 17 to the piano controller 50. One of the pieces of control data expresses a request for accompaniment, and is memorized in a control data code.

While a user is singing a song, the central processing unit 11 produces the pieces of music data J through the analysis on the voice signal, and supplies the pieces of music data J to the communication interface 16 together with the pieces of music data J duplicated from the music data codes stored in the random access memory.

The memory unit 18 has a large amount of data holding capability in a non-volatile manner. In this instance, the memory unit 18 is implemented by a hard disk driver unit. However, another sort of non-volatile memory such as, for example, a flash memory is available for the voice recognizer 10. Sets of music data codes expressing pieces of music are stored in the memory unit 18. The formats of music data codes are defined in the MIDI protocols, and the tones to be generated and tones to be decayed are expressed as the note-on events and note-off events. Term "event" stands for both of the note-on event and note-off event.

The computer program may be stored in the memory unit 18 instead of the read only memory 13 so that the computer program is transferred from the memory unit 18 to the random access memory 14 during an initialization of the system. Sets of music data codes are stored in the memory unit 18. When the user instructs the central processing unit 11 to reenact a piece of music, the central processing unit 11 transfers the set of music data expressing the piece of music through the communication interface 17 to the piano controller 50. On the other hand, when the user instructs the central processing unit 11 to accompany his or her song on the acoustic piano 30, the central processing unit produces the pieces of music data J expressing the tones on the melody to be sung by the user through the analysis on the voice signal, and duplicates the pieces of music data J expressing the tones on the other part from a set of music data. Thus, the sets of music data codes serve as an origin of the pieces of music data J as well as the voice signal. Of course, a user may request the central processing unit 11 to transfer only the pieces of music data J for the tones on the melody to the communication interface 17.

The tone generator 19 is responsive to the music data codes so as electronically to produce the audio signal from pieces of waveform data, and the audio signal is supplied from the tone generator 19 to the sound system 22. The central processing unit 11 transfers the voice data codes to the digital-to-analog converter 23, and the voice data codes are converted to the analog signal through the digital-to-analog converter 23. The analog signal is also supplied from the digital-to-analog converter 23 to the sound system 22, and the electric tones are radiated from the sound system 22 along the melody of the song.

The piano controller 50 includes a communication interface 51, a signal interface 51*a*, a central processing unit 52, which is also abbreviated as "CPU", a timer 53, a read only memory 54, which is also abbreviated as "ROM", a random access memory 55, which is also abbreviated as "RAM", pulse width modulators 56/57, which are abbreviated as "PWM", a motor driver 58 and a shared bus system 64. These system components 51, 51*a*, 52, 53, 54, 55, 56, 57 and 58 are connected to the shared bus system 64 so that the central processing unit 52 is communicable with the other system components 51, 51*a*, and 53 to 58 through the shared bus system 64.

The central processing unit 52 is the origin of the data processing capability of the piano controller 50, and a computer program and parameters are stored in the read only memory 54. The central processing unit 52 sequentially fetches the instruction codes of the computer program from the read only memory 54, and achieves tasks expressed by the instruction codes. Temporary data storage, flags and registers are defined in the random access memory 55.

The timer 53 measures a lapse of time from the initiation of the automatic playing and time intervals for the timer interruptions. The communication interface 51 is connected to the communication interface 17, and receives the music data codes and control data code from the voice recognizer 10. The signal interface 51*a* includes analog-to-digital converters, which are selectively connected to the built-in plunger sensors 59*a* and 60*a*. The signal interface 51*a* periodically samples discrete values on the key position signals xk and discrete values on the pedal position signals xp, and the discrete values are memorized in key position data codes and pedal position data codes. The music data codes, control data code, key position data codes and pedal position data codes are periodically fetched by the central processing unit 52, and are stored in the random access memory 55.

The pulse width modulators 56 and 57 are responsive to control data codes, which are supplied from the central processing unit 52 through the shared bus system 64, so as to adjust the driving signals uk(t) and up(t) to target values of the duty ratio, and supply the driving signals uk(t) and up(t) to the solenoid-operated key actuators 59 and solenoid-operated pedal actuators 60. Thus, the piano controller 50 selectively energizes the solenoid-operated key actuators 59 and solenoid-operated pedal actuators 60 with the driving signals uk(t) up(t) so as to give rise to the key motion and pedal motion without any fingering and footwork of a human player.

The motor driver 58 is connected to the electric motor 61, and is responsive to a control data code, which is supplied from the central processing unit 52 through the shared bus system 64, so as bi-directionally to rotate the hammer stopper 35*a*. Thus, the piano controller 50 changes the hammer stopper 35*a* between the free position and the blocking position.

A main routine program and subroutine programs form the computer program running on the central processing unit 52. One of the subroutine programs is assigned to the automatic playing for reenacting an original performance, and another subroutine program is assigned to the automatic playing for the real-time accompaniment. Yet another subroutine program is assigned to a data fetch from the communication interface 51 and signal interface 51*a*, and the music data codes, control data codes and plunger position data codes are stored in the temporary data storage in the random access memory 55. The main routine program periodically branches to the subroutine programs through the timer interruptions.

When the main routine program starts to run on the central processing unit 52, the central processing unit 52 firstly initializes the piano controller 50. The main routine program periodically branches to the subroutine program for the data fetch. When the central processing unit 52 enters the subroutine program for the data fetch, the central processing unit 52 checks the communication interface 51 and signal interface 51*a* to see whether or not any piece of control data, music data and position data arrives at the communication interface 51. If any piece of control data does not reach the communication interface 51, the central processing unit 52 returns to the main routine program. When the central processing unit 52 finds a piece of control data, the central processing unit 52 interprets the piece of control data, and selectively raises or lowers the flags. On the other hand, the central processing unit 52 transfers the pieces of music data and pieces of position data to the random access memory 55, and writes them in the temporary data storages assigned thereto.

When the central processing unit 52 enters the subroutine program for the automatic playing, the central processing unit 52 checks the flag in the random access memory 55 to see whether or not the user has requested to reenact a performance. If the flag is found to be lowered, the central processing unit 52 returns to the main routine program. When the answer is given affirmative, the central processing unit 52 requests the central processing unit 11 to transfer a set of music data codes expressing the piece of music to reenact from the memory unit 18 through the communication interface 17 to the communication interface 51. The music data codes are transferred from the communication interface 51 to the random access memory 55 through the subroutine program for the data fetch. When the set of music data codes is accumulated in the random access memory 55, the central processing unit 52 sequentially reads out the music data codes so as selectively to drive the solenoid-operated key actuators 59 and solenoid-operated pedal actuators 60. Thus, the black and white keys 31*a*/31*b* and pedals Pd/Ps are selectively depressed and released so that the piano controller 50 reenacts the piece of music on the acoustic piano 30.

When the central processing unit 52 enters the subroutine program for the accompaniment, the central processing unit 52 firstly checks the flag in the random access memory 55 to see whether or not the user has requested the accompaniment. If the answer is given negative, the central processing unit 52 returns to the main routine program. When the central processing unit 52 finds the flag to have been already raised, the central processing unit 52 accesses the temporary data storage, and reads out the music data codes expressing the acoustic piano tones to be produced for the accompaniment. The central processing unit analyzes the pieces of music data stored in the read-out music data codes, and selectively drives the solenoid-operated key actuators 59 and solenoid-operated pedal actuators 60 for the accompaniment.

Turning back to FIG. 1 of the drawings, functions of the voice recognizer 10 and functions of the piano controller 50 are illustrated. These functions are realized through the execution of the computer programs described hereinbefore. The events to be taken place due to the song are hereinafter referred to as "vocal events J(v)", and the events duplicated from the music data codes are referred to as "sequential events J(s)".

The voice recognizer 10 realizes the functions 23, 24, 25, 26 and 27, which are called as "volume analysis", "pitch analysis", "pitch name analysis", "data preparation" and "sequential event search". The voice recognizer 10 analyzes the volume or loudness for the volume signal through the function 23, and determines the loudness of the voice of a singer. The voice recognizer 10 further analyzes the pitch of the voice for the volume signal through the function 24, and determines the pitch of the voice. When the pitch is determined, the voice recognizer 10 determines what pitch name N is the closest to the pitch of the voice in the equal temperament through the function 25, and, thereafter, prepares the piece of music data expressing the tone assigned the pitch name N through the function 26. The piece of music data is stored in the music data code expressing the vocal event J(v), and the music data code is supplied from the voice recognizer 10 to the piano controller 50. The voice recognizer 10 further prepares the music data code or codes for the sequential event or events J(s) through the function 27, if any, and supplies the music data code or codes to the piano controller 50.

Boxes 62 and 63 stand for functions of the piano controller 50. The piano controller 50 determines a reference trajectory, a series of values of a target key position, for a black/white key 31*a*/31*b*, and varies the amount of mean current so as to force the black/white key 31*a*/31*b* to travel on the reference trajectory through the function 62. If the music data code expresses the vocal event J(v), the piano controller 50 adjusts the driving signal uk(t)/up(t) to the amount of mean current without any delay. For this reason, the solenoid-operated key actuator 59 or solenoid-operated pedal actuator 60 starts to move the black/white key 31*a*/31*b* or pedal Pd/Ps immediately after the arrival of the music data code.

On the other hand, if the music data code expresses the sequential event J(s), the piano controller 50 introduces a delay time through the function 63 into the adjustment of the driving signal uk(t) or up(t) to the amount of mean current. This is because of the fact that the load on the plungers 59*a* is different, Most of the load on the plunger 59*a* is due to the self-weight of the associated action unit 33 and hammer 32 which is varied together with the pitch name assigned to the black/white key 31*a*/13*b*. For this reason, the delay time is determined on the basis of the pitch name and velocity. A delay table is prepared in the read only memory 54, and the central processing unit 52 accesses the delay table for the sequential events j(s). The amount of mean current is equivalent to the duty ratio of the driving signal, and the adjustment is carried out by means of the pulse width modulators 56/57. Thus, the piano controller 50 gives rise to the key motion or pedal motion by means of the solenoid-operated key actuator 50 or solenoid-operated pedal actuator 60 as if a human player accompanies the song on the acoustic piano 30. Since the human singer makes only one tone once, the vocal events J(v) are to be taken place in series. Of course, it is possible that more than one sequential event J(s) concurrently takes place.

While the automatic player 1 is accompanying a song on the acoustic piano 30, the sequential events J(s) are delayed. However, the vocal events J(v) are not delayed in order to make the piano tones well synchronized with the song.

Figure 3:
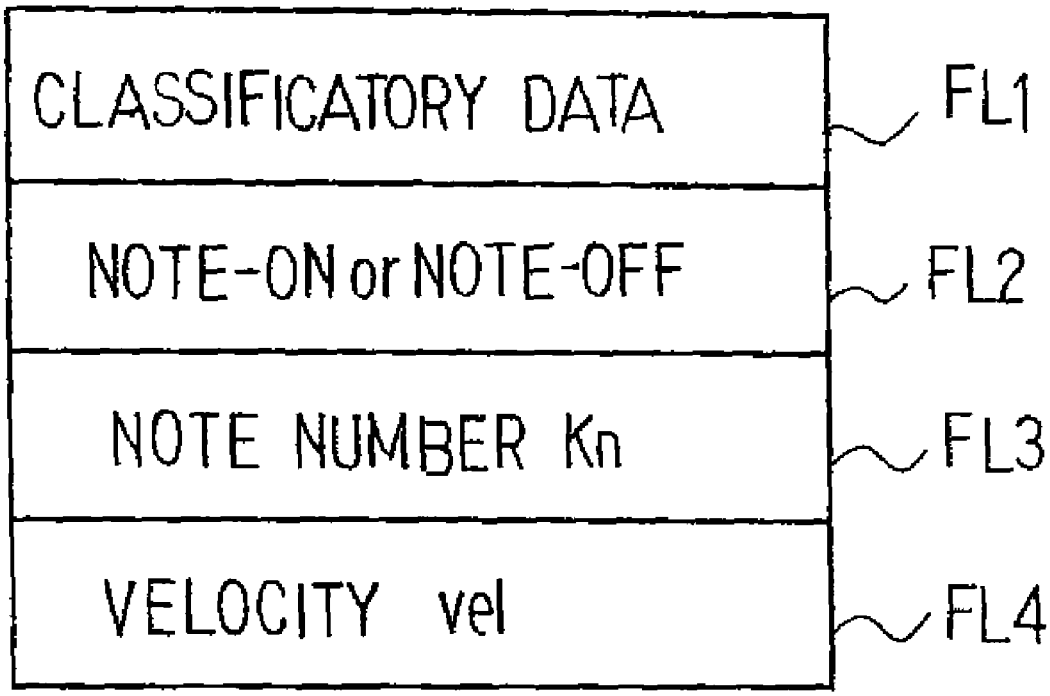
FIG. 3 is a view showing a format of a music data code to be processed in the automatic player.

FIG. 3 shows a format of the music data codes for events, i.e. both of the vocal event and sequential event. The music data code for an event includes data fields FL1, FL2, FL3 and FL4, which are respectively assigned to classificatory data, sort of event, i.e., the note-on or note-off, note number Kn and velocity vel. The classificatory data is indicative of either vocal event J(v) or sequential event J(s), and the note-on and note-off are representative of the generation of tone and the decay of the tone, respectively. The note number Kn is indicative of the pitch name at which the tone is to be produced, and is equivalent to the pitch name N. The velocity vel for the note-on event J(v) is proportional to the loudness of the voice, and the velocity vel for the note-off event J(v) is adjusted to a default value. On the other hand, the sort of event, note number Kn and velocity vel for the sequential events J(s) are duplicated from the music data codes.

Description is hereinafter made on the computer program with reference to FIGS. 4A, 4B, 5A, and 5B.

Figure 4A:
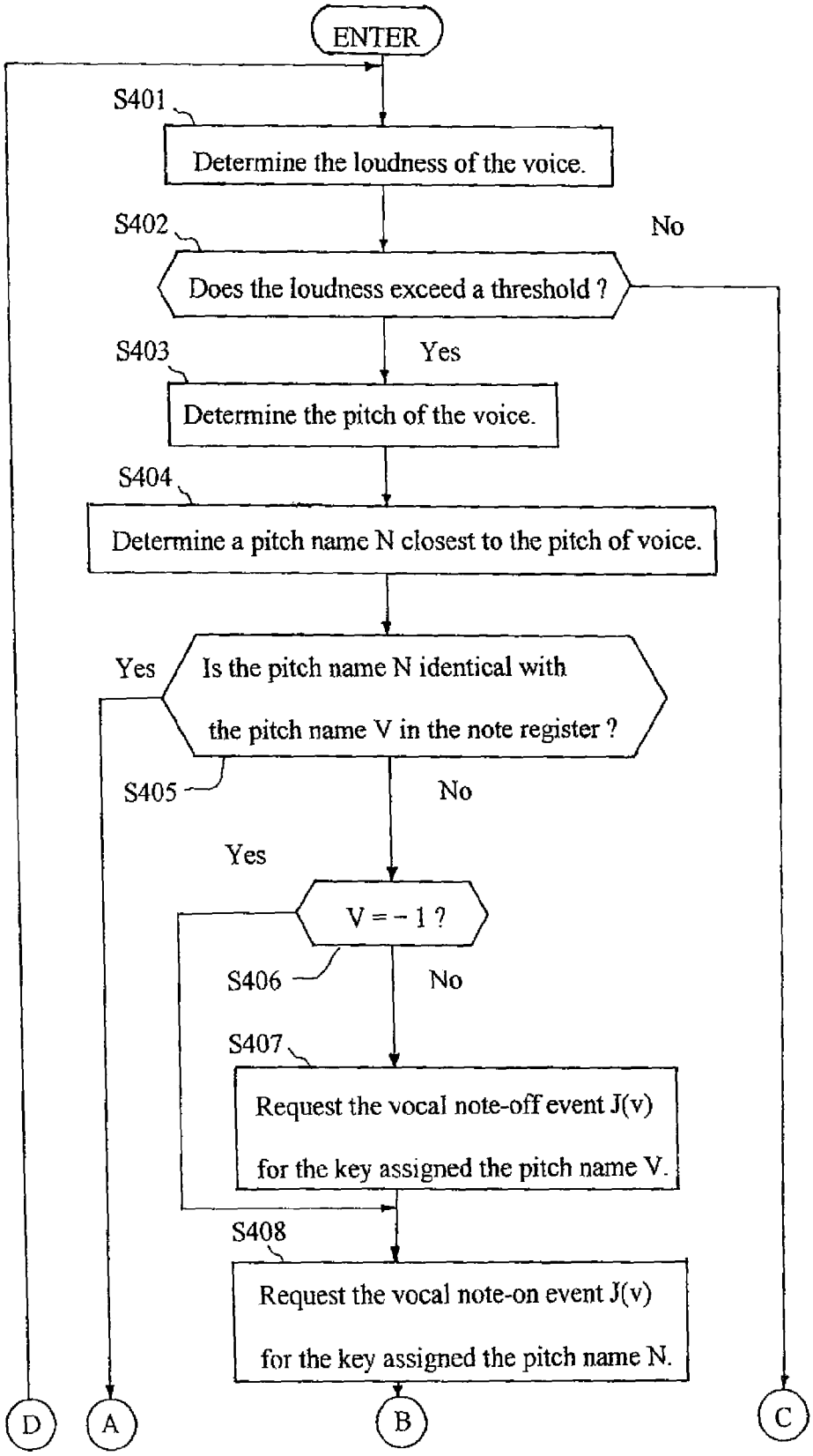
FIGS. 4A and 4B are flowcharts showing a computer program running on a voice recognizer.
Figure 4B:
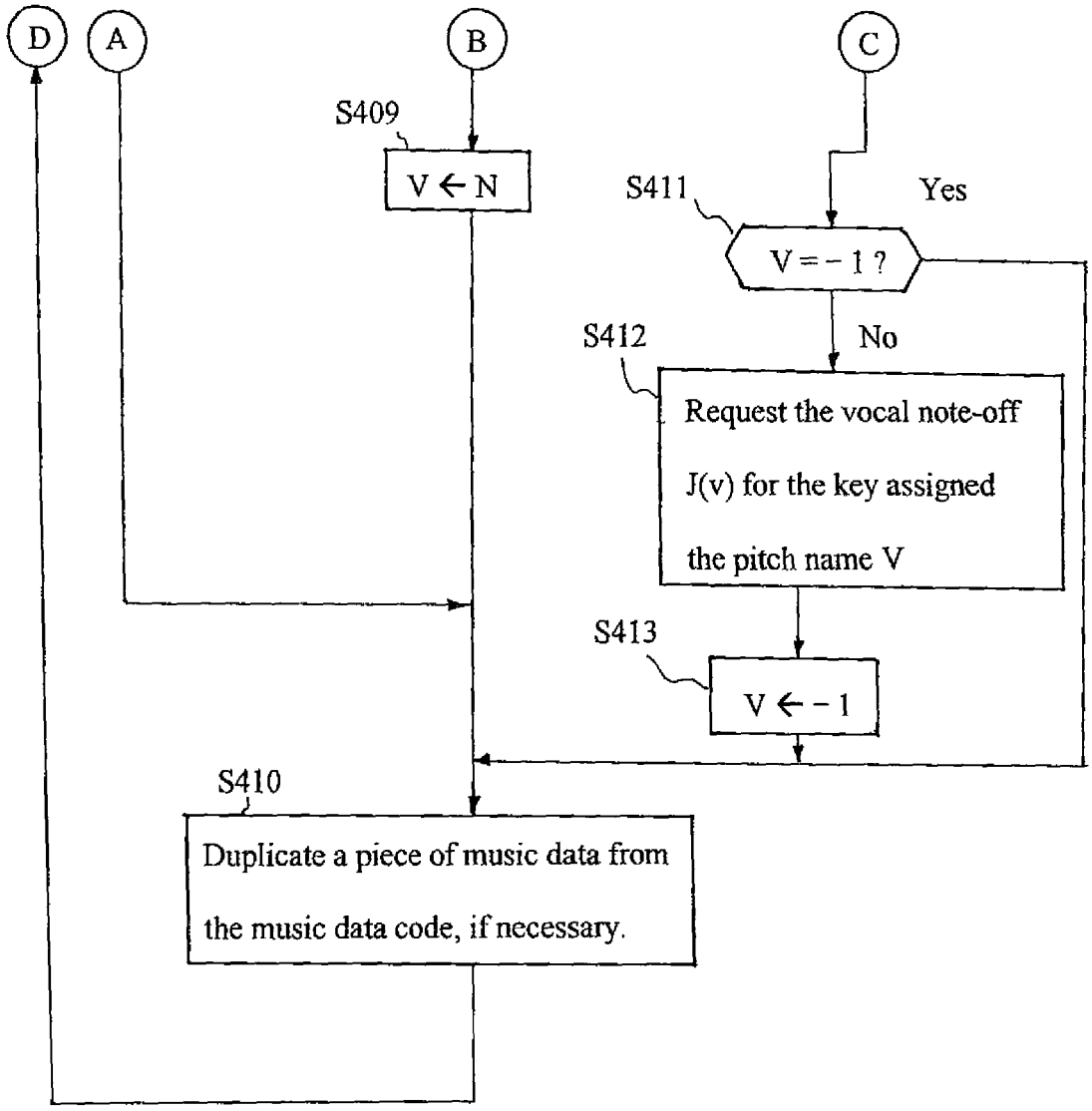

FIGS. 4A and 4B show the subroutine program for the voice recognition. The central processing unit 11 periodically enters the subroutine program for the voice recognition, sequentially executes the Jobs, and returns to the main routine program. In other words, the central processing unit 11 repeats the entry into the subroutine program, execution of the jobs and return to the main routine program at each timer interruption.

A user is assumed to instruct the automatic player 1 to accompany his or her song on the acoustic piano 30. The accompaniment is to be constituted by the tones of a part sung by the user and tones of another part expressed by the music data codes selected from a set of music data codes.

Upon acknowledgement of the instruction of the user, the central processing unit 11 writes "−1" into a note register, which is created in the random access memory 14. The value "−1" is indicative of silent state, that is, the user has not started to sing the song, yet, and a transit state between the tones. The central processing unit 11 starts to measure the lapse of time, and determines the timing at which the main routine program is to branch to the subroutine program. Although the central processing unit 11 returns to the main routine program after the execution for a predetermined time period, the Jobs in the subroutine program are hereinafter described as if the central processing unit 11 continuously reiterates the subroutine program.

When the central processing unit 11 enters the subroutine program, the central processing unit 11 firstly reads out the voice data code from the head of a queue, into which the voice data codes periodically enter through the subroutine program for the data fetch, and determines the loudness of the voice expressed by the voice data code as by step S401.

Subsequently, the central processing unit 11 compares the value of the loudness with a threshold value to see whether or not the voice exceeds the predetermined loudness as by step S402. If the user has not started to sing the song, yet, the music data code expresses only noise, the loudness of which is lower than the threshold value, and the answer is given negative "No". Then, the central processing unit 11 proceeds to step S411' and checks the note register to see whether or not the pitch name V is expressed by a "−1". The answer at step S411 is given affirmative "Yes" before the user starts to sing the song.

With the positive answer at step S411, the central processing unit 11 proceeds to step S410, and searches the set of music data codes for a music data code to be presently processed. If the central processing unit 11 does not find any music data code to be presently processed, the central processing unit 11 returns to step S401. On the other hand, when the central processing unit 11 finds a music data code or codes, the central processing unit 11 duplicates the key number Kn and velocity vel from the music data code or codes to the music data code or codes shown in FIG. 3, and supplies the music data code or codes to the piano controller 50. Upon completion of the jobs at step S410, the central processing unit 11 returns to step S401. Thus, the central processing unit 11 reiterates the loop consisting of steps S401, S402, S411 and 412 until the answer at step S402 is changed to affirmative "Yes".

The user is assumed to start to sing the song. The loudness exceeds the threshold value, and the answer at step S402 is changed to affirmative "Yes". With the positive answer "Yes", the central processing unit 11 determines the pitch of the vocal tone as by step S403. Although the user tries to sing the song expressed by the notes on the music score, the pitch of voice is not always consistent with the pitch of notes. For this reason, the central processing unit 11 compares the pitch of voice with the pitch of candidates to see what tone the user wished to pronounce, and determines the pitch name N closest to the pitch of voice as by step S404. The candidates are the pitch names assigned to all of the black and white keys 31*a*/31*b*.

Subsequently, the central processing unit 11 checks the note register to see whether or not the pitch name N is identical with the pitch name V stored in the note register as by step S406. If the tone has been already produced at the pitch name N, the pitch name N was written in the note register, and the answer is given positive "Yes". In this situation, the user continuously pronounces the vocal tone at the pitch N over the sampling time period. For this reason, the central processing unit 11 discards the voice data code, and proceeds to step S410. The job at step S410 has been already described.

However, if the tone N has not been produced, yet, the answer at step S405 is given negative "No". Then, the central processing unit 11 checks the note register to see whether or not "−1" has been written in the note register as by step S406. When the tone N is found at the head of the music passage, the answer is given affirmative "Yes". Similarly, when the user enters the transit state between a tone and another tone, the answer at step S406 is also given affirmative "Yes". However, when the user changes the vocal tone to the pitch name N, the previous pitch name V is stored in the note register, and the answer at step S406 is given negative "No".

The answer at step S406 is assumed to be given affirmative. With the positive answer "Yes", the central processing unit 11 proceeds to step S408. The central processing unit 11 produces the music data code expressing the vocal note-on event J(v) for the key 31*a*/31*b* assigned the pitch name N, and supplies the music data code to the piano controller 50 through the communication interface 17. The central processing unit determines the key number Kn and velocity vel on the basis of the pitch name N and loudness, and stores the code expressing the vocal event J(v), code expressing the note-on, key number Kn and velocity vel in the data fields FL1, Fl2, FL3 and FL4, respectively. Upon completion of the job at step S408, the central processing unit 11 writes the pitch name N in the note register as by step S409. Thus, the pitch name of the tone produced through the acoustic piano 30 is registered in the note register as the pitch name V.

When the user changes the tone from the pitch V to the pitch N, the answer at step S406 is given negative "No", and the central processing unit 11 produces the music data code expressing the vocal note-off event for the key 31*a*/31*b* assigned the pitch name V so as to request the piano controller 50 to decay the tone at the pitch V as by step S407. The code expressing the vocal event J(v), note-off, key number Kn and predetermined velocity vel are stored in the data fields FL1, FL2, FL3 and FL4, respectively. Thereafter, the central processing unit 11 requests the vocal note-on event J(v) for the key 31*a*/31*b* assigned the pitch name N as by step S408, and rewrites the note register from the pitch name V to the pitch name N as by step S409. Upon completion of the job at step S409, the central processing unit 11 proceeds to step S410, and searches the set of music data codes for a music data code to be duplicated for the sequential event J(s).

Thus, while the user is singing the song, the central processing unit 11 reiterates the loop consisting of steps S401 to S410, and sends the music data codes expressing the vocal events J(v) and sequential events J(s) to the piano controller 50.

The user is assumed to enter a rest between the notes on the music score. The loudness is reduced below the threshold value, and the pitch name V of the previous tone is found in the note register. In this situation, the answer at step S402 is given negative "No", and the answer at step S411 is also given negative "No". Then, the central processing unit 11 produces the music data code expressing the vocal note-off event J(v) for the key 31*a*/31*b* assigned the pitch name V as by step S412, and sends the music data code to the piano controller 50 so that the tone assigned the pitch name V is decayed. Subsequently, the central processing unit 11 rewrites the note register from the pitch name V to −1 as by step S413. As a result, when the user exits from the rest, the central processing unit 11 proceeds to step S408 through the steps S402 and S406 with the positive answers "Yes", and produces the music data code expressing the vocal note-on event (v) for the tone assigned the pitch name N.

As will be understood from the foregoing description, the voice recognizer 10 produces the music data codes expressing the vocal events J(v) from the voice signal and the sequential events J(s) through the duplication from the music data codes, and supplies the music data codes to the piano controller 50.

Figure 5A:
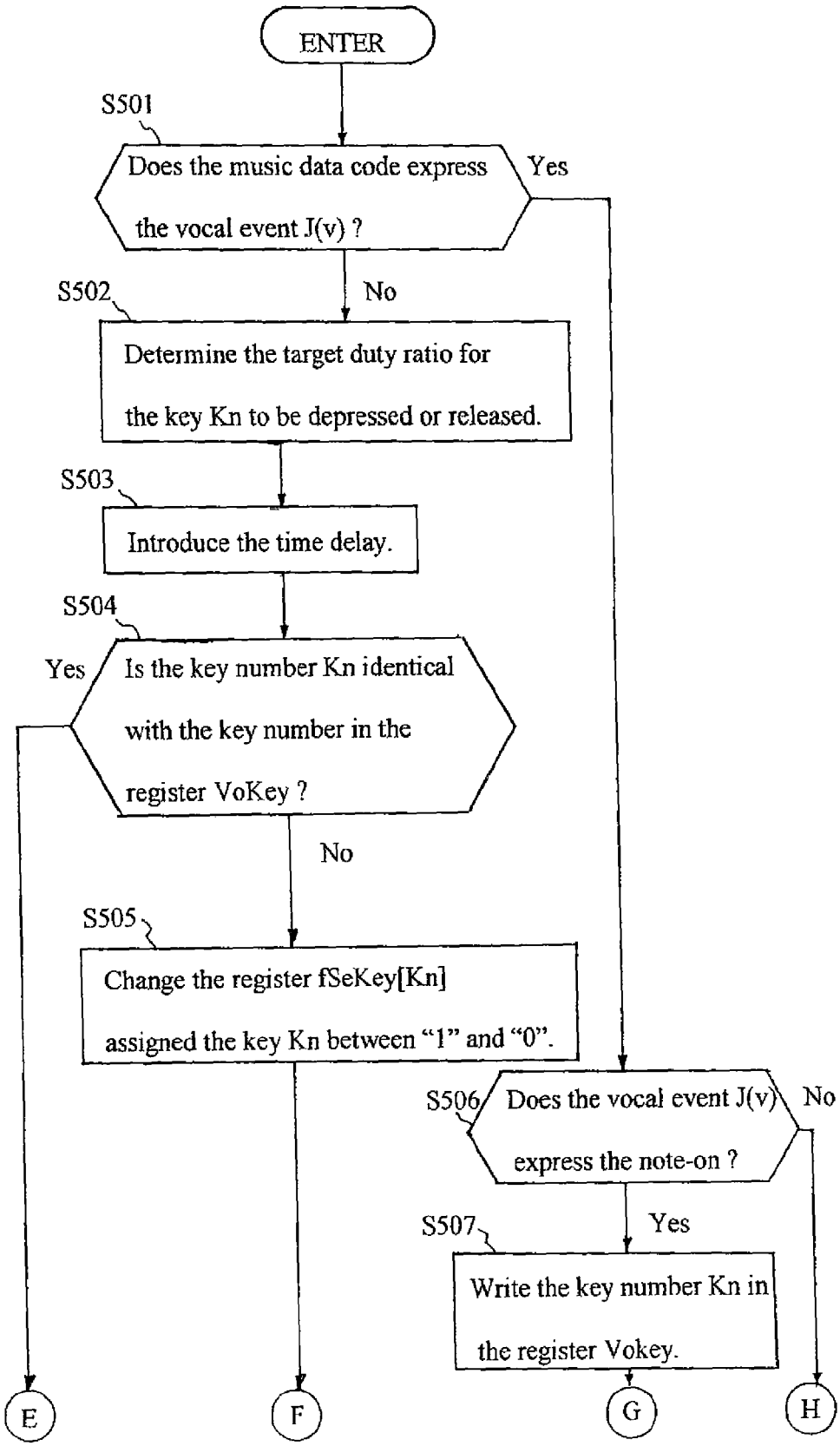
FIGS. 5A and 5B are flowcharts showing a computer program running on a piano controller.
Figure 5B:
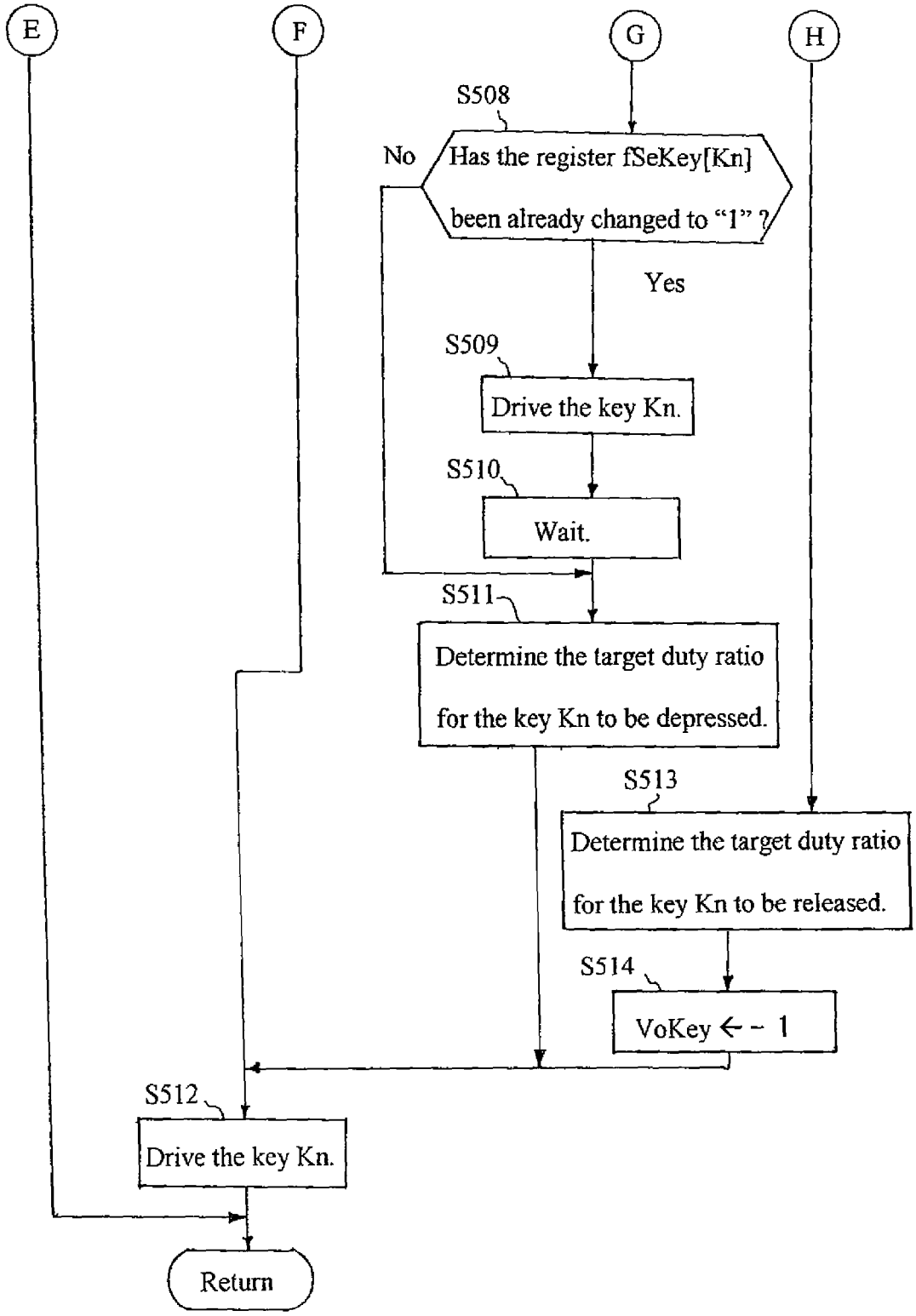

FIGS. 5A and 5B illustrate the subroutine program for the accompaniment. When the user instructs the automatic player 1 to accompany the song on the acoustic piano 30, the central processing unit 11 supplies the control data code expressing the user's instruction through the communication interface 17 to the piano controller 50. The central processing unit 52 raises the flag indicative of the accompaniment, and writes −1 in a register VoKey, which is created in the random access memory 55 in order to indicate the key number Kn for the vocal event J(v). The central processing unit 52 starts the timer 53 to measure the lapse of time. The main routine program periodically branches to the subroutine program for the accompaniment through the timer interruptions. The main routine program further branches to the subroutine program for the data fetch, and the central processing unit 52 transfers the music data codes to the random access memory 55 so as to make the music data codes enter the tail of a queue in the temporary data storage.

When the central processing unit 52 enters into the subroutine program for the accompaniment, the central processing unit 52 firstly reads out the music data code from the head of the queue, and examines the music data code to see whether or not the vocal recognizer 10 requests the piano controller 50 to produce the vocal event J(v) as by step S501. As described hereinbefore, the events are divided into two groups, i.e., the vocal events J(v) and the sequential events J(s). If the sequential event J(s) is to be produced, the answer at step S501 is given negative "No", and the central processing unit 52 proceeds to step S502. On the other hand, if the vocal event J(v) is to be produced, the answer at step S501 is given affirmative "Yes", and the central processing unit 52 proceeds to step S506.

First, the music data code is assumed to express the sequential event J(s). The central processing unit 52 proceeds to step S502, and analyzes the piece of music data expressing the sequential event J(s). The central processing unit 52 determines a reference key trajectory, i.e., a series of values of the target key position, and the amount of mean current to be required for the arrival at the first value of the target key position. If the music data code expresses the sequential note-on event J(s), the reference key trajectory leads the black/white key 31*a*/31*b* toward the end position. On the other hand, if the music data code expresses the sequential note-off event, the reference key trajectory leads the depressed key 31*a*/31*b* toward the rest position. Thus, the central processing unit 52 determines the target duty ratio for the depressed or released key 31*a*/31*b* assigned the key number Kn as by step S502.

Subsequently, the central processing unit 52 accesses the delay table, and reads out the delay time from the delay table for the black/white key 31*a*/31*b* assigned the key number Kn. The central processing unit 52 starts the timer 53, and keeps the piece of control data expressing the target duty ratio in a register until the delay time is expired. Thus, the central processing unit 52 introduces the delay into the execution of the jobs expressed by the music data code as by step S503.

Subsequently, the central processing unit 52 checks the register VoKey to see whether or not the key number Kn for the sequential event J(s) is identical with the key number presently stored in the register VoKey as by step S504.

If the black/white key 31*a*/31*b* assigned the key number Kn has been already moved for the vocal event J(v), the central processing unit 52 has to ignore the music data code for the sequential event J(s), and the answer at step S504 is given affirmative "Yes" Then, the central processing unit 52 stops the execution of the jobs to be required for the sequential event J(s), and immediately returns to the main routine program. Thus, the sequential event J(s) does not interfere the key motion for the vocal event J(v).

On the other hand, when the black/white key 31*a*/31*b* assigned the key number Kn is different from the key number stored in the register VoKey and −1, the tone to be produced is found in another part of the music score, and the answer at step S504 is given negative "No". Then, the central processing unit 52 changes a register fSeKey[Kn], which is indicative of the current status of the black/white keys 31*a*/31*b* assigned the key number Kn, between 1 and 0 as by step S505. The register fSeKey[Kn] serves as flags, which are respectively assigned to the eighty-eight black and white keys 31*a*/31*b*. When the music data code expresses the vocal note-on event, the register FSeKey[Kn] is changed to 1. On the other hand, if the music data code expresses the vocal note-off event, the register FseKey[Kn] is changed to 0. Thus, the register FseKey[Kn] stands for the current key status of the black/white key 31*a*/31*b* as to the sequential event J(s).

Upon completion of the job at step S505, the central processing unit 52 supplies the control data code expressing the target duty ratio to the pulse width modulator 56 so that the servo control loop starts to force the black/white key 31*a*/31*b* to travel on the reference key trajectory as by step S812. Since the central processing unit 52 has introduced the delay as by step S503, the acoustic piano tone is delayed.

When the music data code expresses the sequential note-on event J(s), the black/white key 31*a*/31*b* travels on the reference key trajectory toward the end position, and makes the hammer 32 strike the strings 34 at the end of the free rotation. The acoustic piano tone is produced at the loudness equivalent to the velocity vel. On the other hand, when the music data code expresses the sequential note-off event J(s), the black/white key 31*a*/31*b* travels on the reference key trajectory toward the rest position, and makes the acoustic piano tone decayed.

On the other hand, when the music data code expresses the vocal event J(v), the answer at step S501 is given affirmative "Yes", and the central processing unit 52 checks the music data code to see whether or not the vocal event J(v) expresses the note-on as by step S506.

When the vocal note-on event J(v) is requested for the black/white keys 31*a*/31*b*, the answer at step S506 is given affirmative "Yes", and the central processing unit 52 writes the key number Kn in toe register VoKey as by step S507. The central processing unit 52 checks the register fSeKey[Kn] to see whether or not the black/white keys 31*a*/31*b* assigned the key number Kn has been already moved, i.e., changed to "1" as by step S508.

If the black/white key 31*a*/31*b* assigned the key number Kn has been moved for the sequential note-on event J(s), the central processing unit 52 instructs the pulse width modulator 56 to make the black/white key 31*a*/31*b* immediately return to the rest position as by step S509, and waits for the arrival at the rest position as by step S510. Upon expiry of the waiting time, the central processing unit 52 proceeds to step S511. Thus, the automatic player 1 makes the accompaniment synchronized with the song.

When the key number in the register fSeKey[Kn] is different from the key number Kn stored in the music data code, the blacks white key 31*a*/31*b* assigned the key number Kn still stays at the rest position, and the answer at step S508 is given negative "No". Then, the central processing unit 52 proceeds to step S511 without any execution at steps S509 and S510.

When the central processing unit 52 reaches step S511, the central processing unit 52 determines the reference key trajectory for the black/white key 31*a*/31*b*, and informs the pulse width modulator 56 of the first value of the target duty ratio. The servo control loop starts to force the black/white key 31*a*/31*b* assigned the key number Kn to travel on the reference key trajectory toward the end position as by step S512. The black/while key 31*a*/31*b* causes the hammer 32 to rotate toward the string 34 so as to produce the acoustic piano tone.

The music data code is assumed to express the vocal note-off event J(v). The answer at step S506 is given negative "No". With the negative answer "No", the central processing unit 52 determines the reference key trajectory for the released key 31*a*/31*b* as by step S513, and changes the register VoKey to −1 as by step S514.

The central processing unit 52 supplies the control data code expressing the target duty ratio to the pulse width modulator 56 so that the servo control loop forces the black/white key 31*a*/31*b* to travel on the reference key trajectory toward the rest position at step S512.

As will be understood, the piano controller 50 prioritizes the vocal events J(s) so that the automatic player 1 does not advance or retard the accompaniment. The automatic player 1 is responsive to the vocal tones of a human signer so as to accompany the song on the acoustic musical instrument such as the piano 30. Thus, the human singers practice the songs without any human player for the accompaniment on the acoustic musical instrument.

Moreover, although the vocal events J(v) take place concurrently with the vocal tones, the sequential events J(s) are delayed from the standard timing. The delay time is proportional to the load on the key actuators 59 so that the sequential events S(s) takes place at the intervals as if a human player accompanies the song on the acoustic musical instrument. Thus, the user feels the accompaniment natural.

The automatic player 1 prioritizes the vocal events J(v) over the sequential events J(s). Even if the user sings a song slower or faster than the song recorded in the set of music data codes, the automatic player 1 cancels the sequential events J(s) identical with the vocal events J(v) (see the path "Yes" from step S504 and steps S508 to S510) so that the tones at the sequential events J(s) follow the vocal tones. Thus, the accompaniment is well synchronized with the singing.

Second Embodiment

Figure 6:
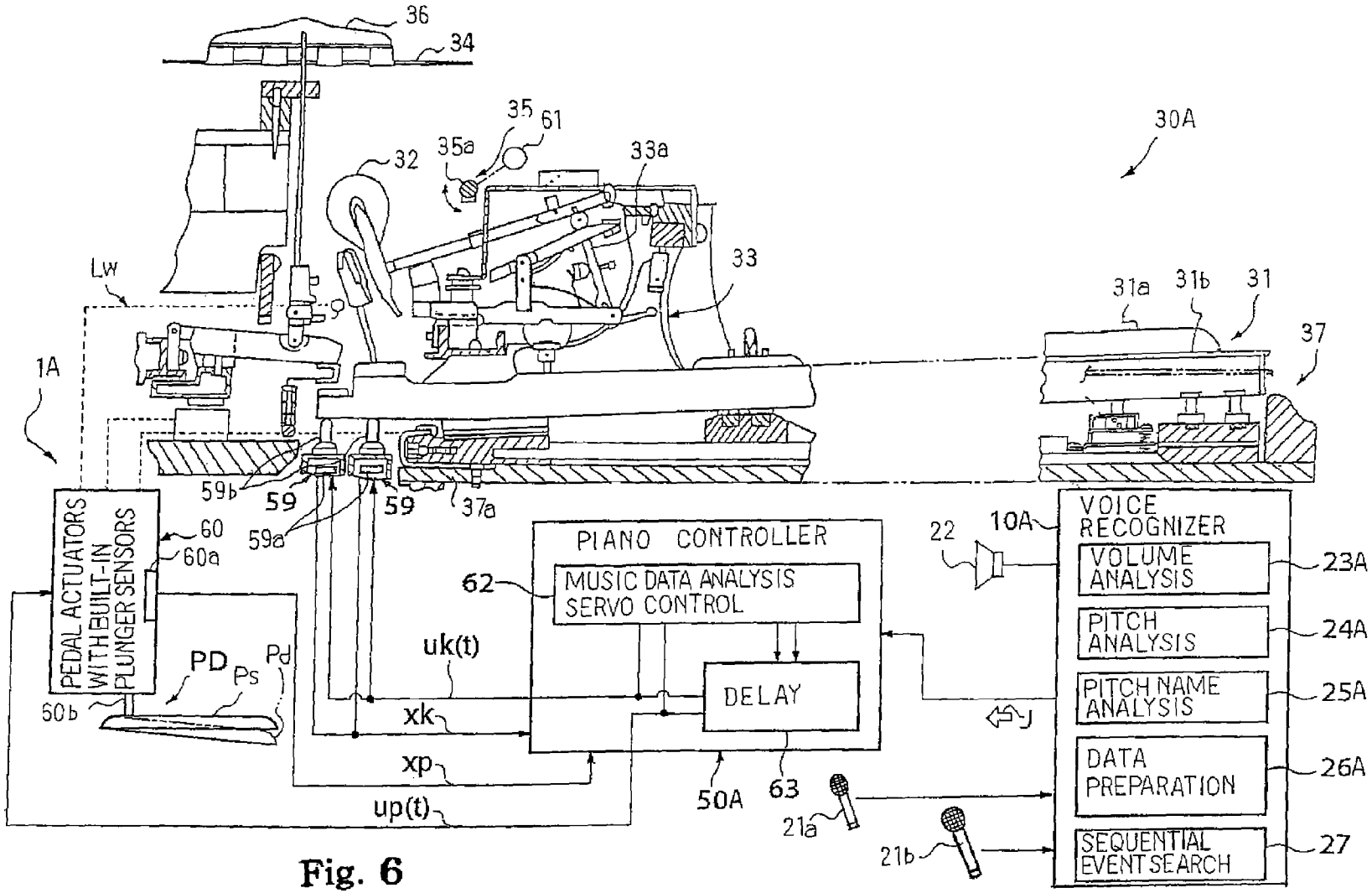
FIG. 6 is a side view showing the structure of another automatic player piano according to the present invention.

Turning to FIG. 6 of the drawings, another automatic player piano embodying the present invention largely comprises an automatic player 1A and an acoustic piano 30A. The acoustic piano 30A is similar in structure to the acoustic piano 30 so that component parts are labeled with reference numerals and signs designating the corresponding component parts of the acoustic piano 30.

On the other hand, the automatic player 1A is different in the data processing from the automatic player 1, and plural microphones 21*a* and 21*b* are pre-pared for plural singers. Since voice signals are input in parallel to the voice recognizer 10A, the volume analysis 23A, pitch analysis 24A pitch name analysis 25A and data preparation 26A are carried out on plural groups of pieces of voice data respective sampled from the voice signals.

The piano controller 50A is similar in system configuration to the controller 50. However, the subroutine program for the accompaniment is slightly different from the subroutine program shown in FIGS. 5A and 5B. Although the key number Kn in the vocal event J(v) is memorized in the note register VoKey in the first embodiment, the note register VoKey is replaced with a flag register fVoKey[Kn], the flags of which are respectively assigned to the black and white keys 31*a*/31*b*.

When a black/while key 31*a*/31*b* starts to travel for the vocal note-on event J(v), the associated flag is raised, i.e., changed to "1". If the black/white key 31*a*/31*b* is staying at the rest position or is found on the way toward the rest position, the flag is lowered. All the flags fVoKey[Kn] are lowered in the initialization. The events are classified in either vocal event J(v) or sequential event j(s) as similar to those in the first embodiment. Although the vocal events J(v) are serially processed in the piano controller 50, the piano controller 50A is to be responsive to the request concurrently to produce more than one vocal event J(v). Description is hereinafter made on the subroutine program for the accompaniment.

Figure 7A:
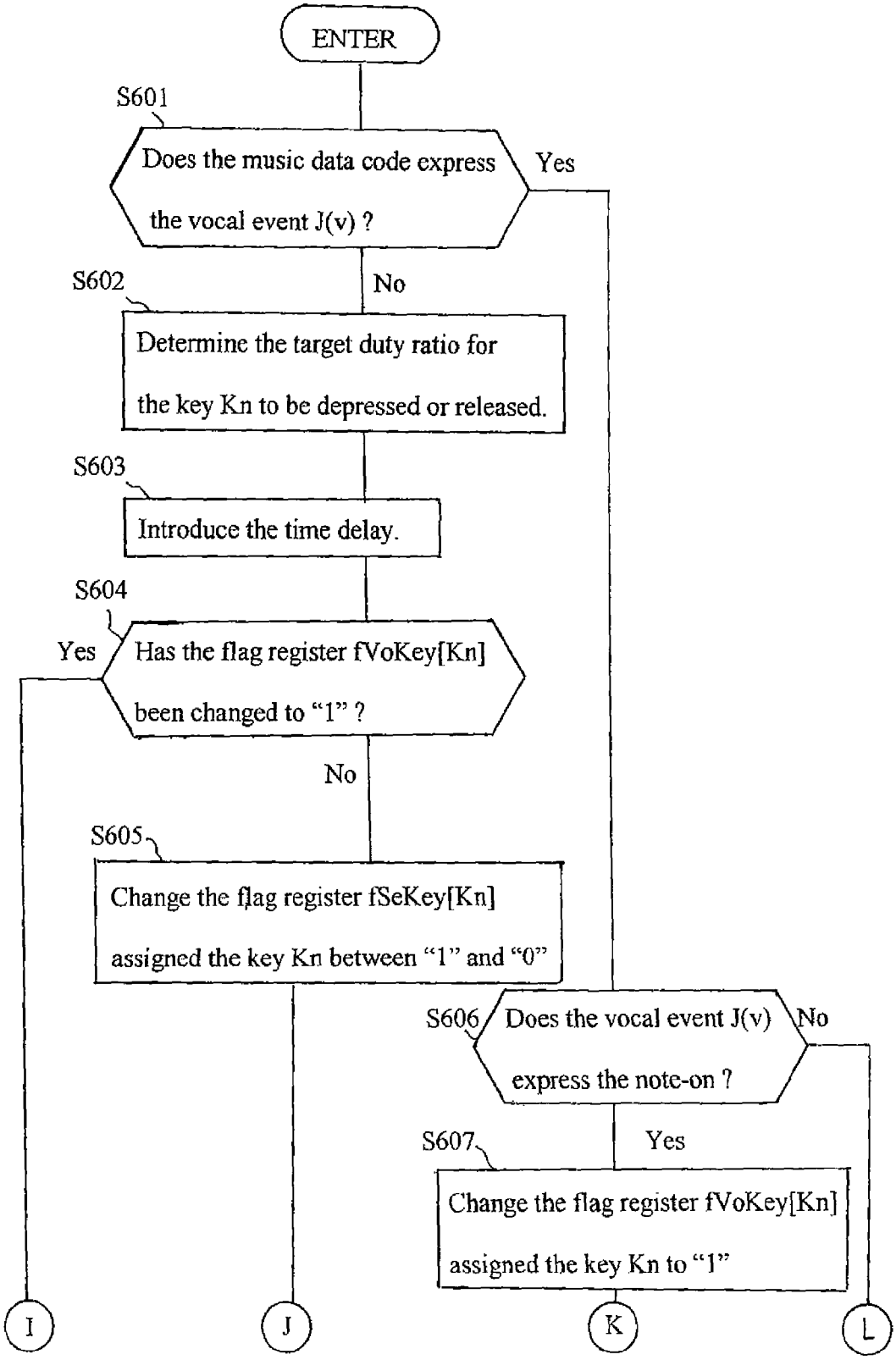
FIGS. 7A and 7B are flowcharts showing a computer program running on a voice recognizer incorporated in another automatic player piano according to the present invention.
Figure 7B:
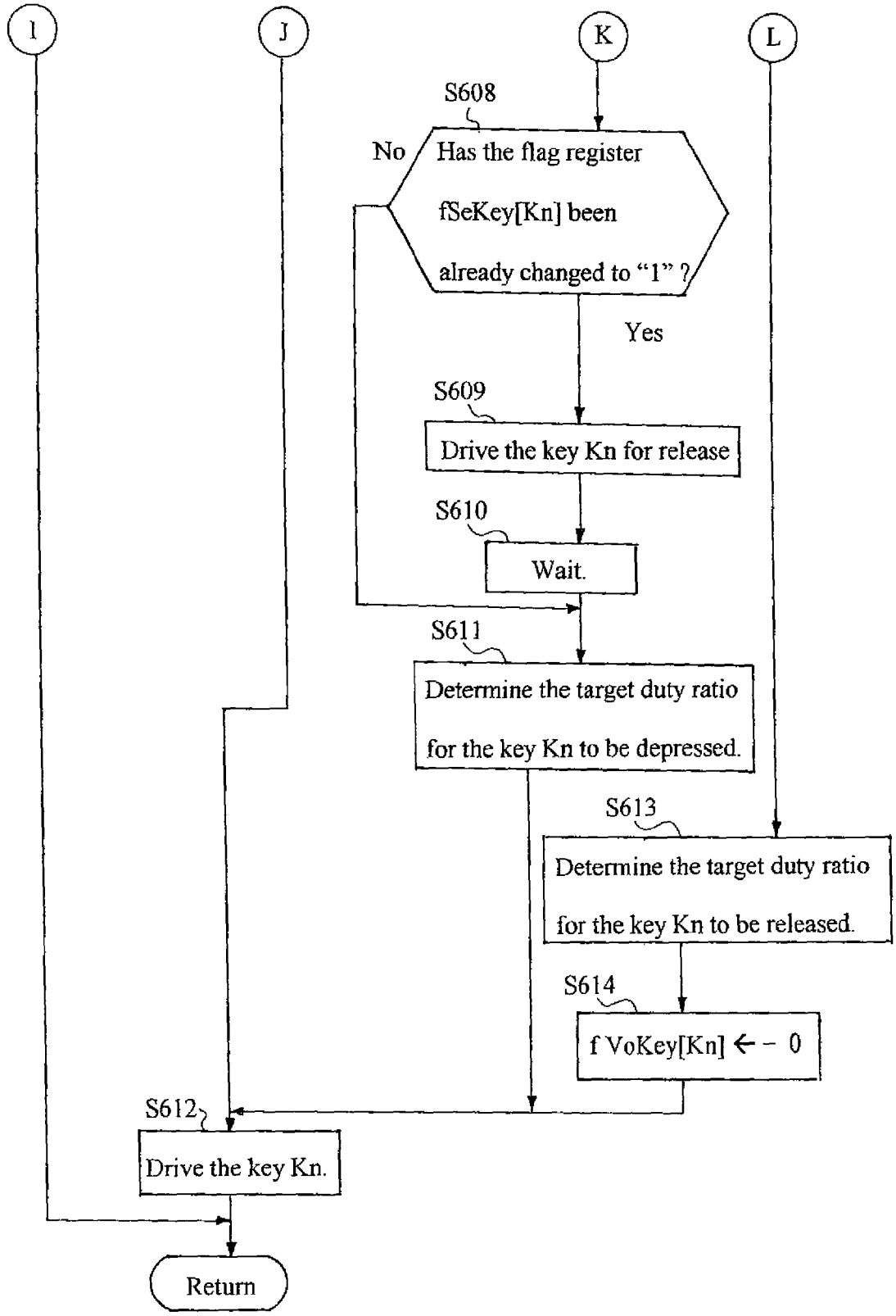

FIGS. 7A and 7B illustrate the subroutine program for the accompaniment. The jobs at steps S601 to S603, S606 and S608 to S613 are identical with the jobs at steps S501 to S503, S506 and S508 to S513, and description is omitted for avoiding repetition.

Upon completion of the job at step S603, the central processing unit 52 checks the flag register fVoKey[Kn] to see whether or not the black/white key assigned the key number Kn has bee already moved for the vocal note-on event J(s) as by step S604. If the flag associated with the key number Kn has been already raised or changed to "1", the answer is given affirmative "Yes", and the central processing unit 52 immediately returns to the main routine program. In other words, the central processing unit 52 ignores the sequential event J(s) for the key 31*a*/31*b* assigned the key number Kn.

If the central processing unit 52 finds the flag associated with the black/white key 31*a*/31*b* assigned the key number Kn to be lowered, i.e., "0", the answer at step S604 is given negative "No", and the central processing unit 52 changes the flag fSeKey[Kn] from "0" to "1" or vice versa as by step S605. In more detail, when the sequential event J(s) expresses the note-on, the central processing unit 52 raises the flat associated with the key number Kn, i.e., changes the flag to "I". On the other hand, if the sequential event J(s) expresses the note-off, the central processing unit 52 lowers the flag, i.e., change it to "0".

When the central processing unit 52 finds the music data code to express the note off event, the answer at step S601 is given affirmative "Yes", and the central processing unit 52 proceeds to step S606. The job at step S606 is identical with the job at step S506. When the central processing unit 52 finds the vocal event J(v) to be for the note-on, the answer at step S606 is given affirmative "Yes", and the central processing unit 52 changes the flag in the flag register fVoKey[Kn] to "1" as by step S607. Thus, the piano controller 50A memorizes the key number Kn assigned to the black/white key 31*a*/31*b* already driven to produce the piano tone in the flag register fVoKey[Kn]. Thus, the job at step S607 permits the central processing unit 52 to make the decision at step S604.

As will be appreciated from the foregoing description, while singers are exercising themselves in duet, the automatic player 1A accompanies the duet on the acoustic piano 30A in good synchronism with the vocal tones. The automatic player piano implementing the second embodiment achieves all the advantages of the first embodiment.

Third Embodiment

Yet another automatic player piano embodying the present invention also largely comprises an acoustic piano and an automatic player. The acoustic piano is similar in structure to the acoustic piano 30, and the automatic player is analogous to the automatic player 1 except for a subroutine program for the voice recognition. For this reason, description is focused on the subroutine program for the voice recognition for the sake of simplicity.

The voice recognizer determines chords along the music passage sung by a human singer, and supplies the music data codes expressing the tones forming the chords to the piano controller. However, any piece of music data is not duplicated from the MIDI music data codes stored in the memory unit.

Figure 8A:
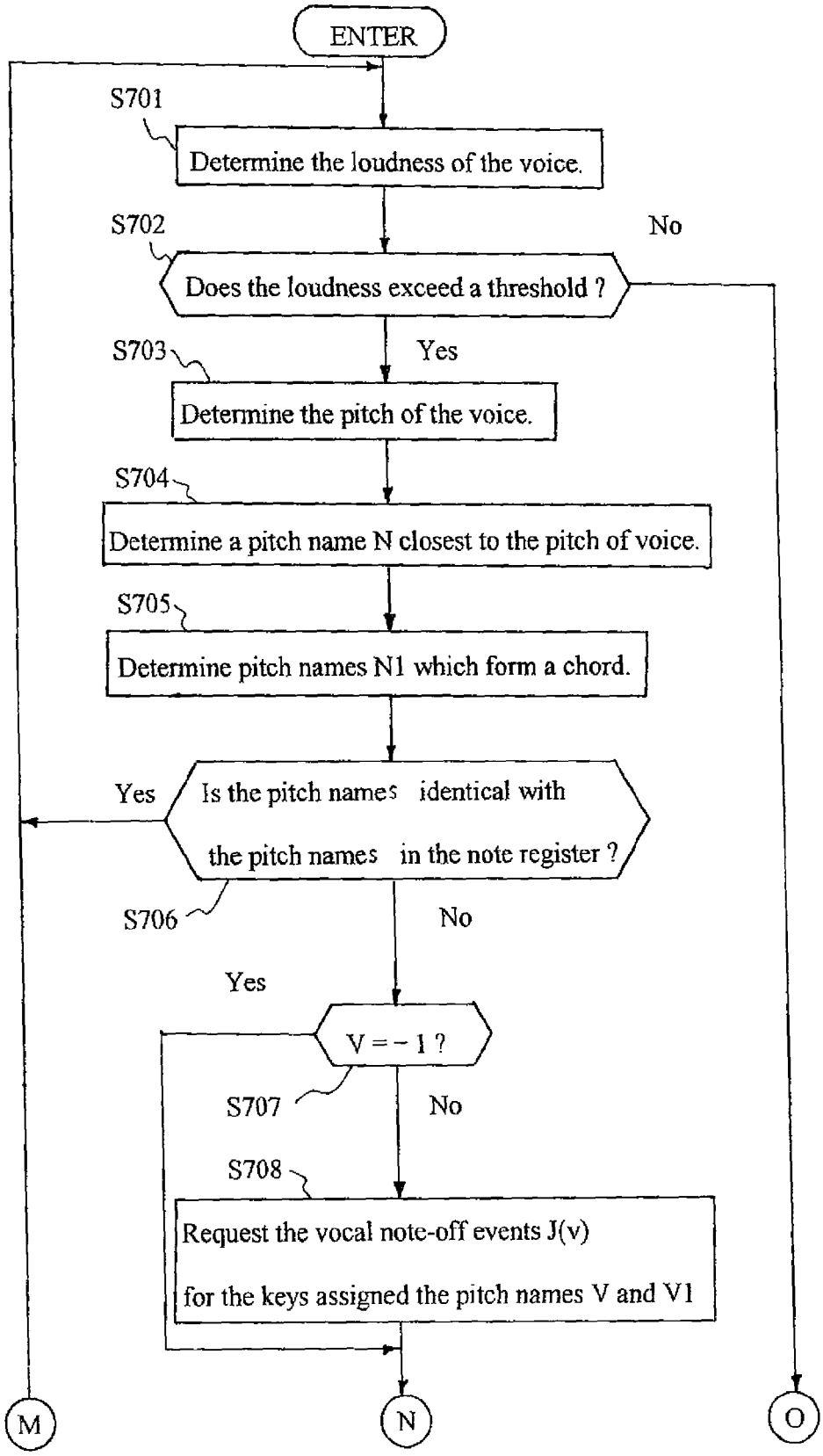
FIGS. 8A and 8B are flowcharts showing a computer program for a voice recognition employed in yet another automatic player piano according to the present invention.
Figure 8B:
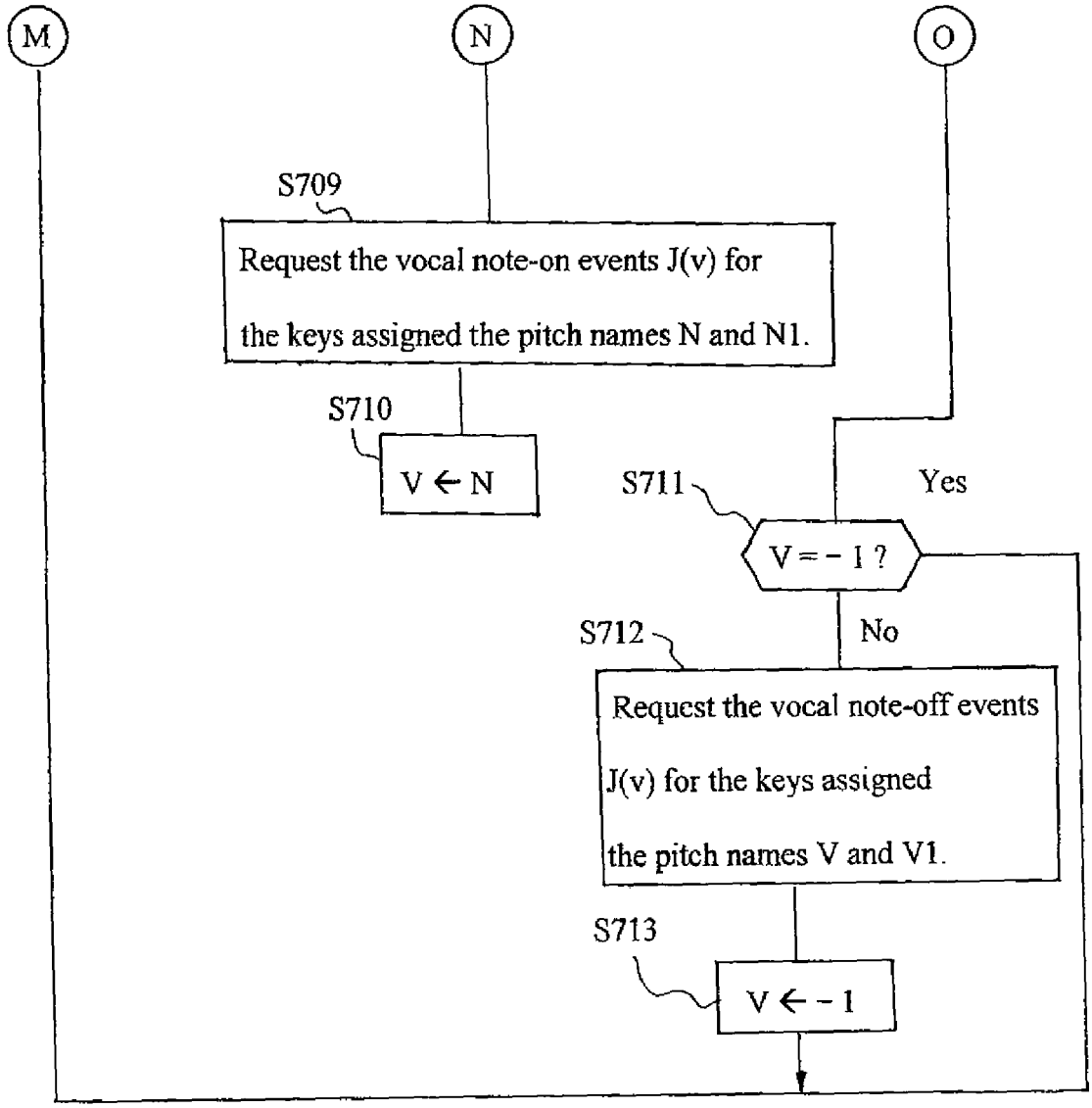

FIGS. 8A and 8B illustrate the subroutine program for the voice recognition. Since the voice recognizer is similar in system configuration to the voice recognizer 10, the system components are labeled with the references same as those designating the corresponding system components of the voice recognizer 10.

A user is assumed to instruct the automatic player to accompany his or her song on the acoustic piano. Upon acknowledgement of the instruction of the user, the central processing unit 11 writes "−1" into a note register, which is created in the random access memory 14. The value "−1" is indicative of silent state, that is, the user has not started to sing the song, yet, and a transit state between the tones. The central processing unit 11 starts to measure the lapse of time, and determines the timing at which the main routine program is to branch to the subroutine program. Although the central processing unit 11 returns to the main routine program after the execution for a predetermined time period, the jobs in the subroutine program are hereinafter described as if the central processing unit 11 continuously reiterates the subroutine program.

When the central processing unit 11 enters the subroutine program, the central processing unit 11 firstly reads out the voice data code from the head of a queue, into which the voice data codes periodically enter through the subroutine program for the data fetch, and determines the loudness of the voice expressed by the voice data code as by step S701.

Subsequently, the central processing unit 11 compares the value of the loudness with a threshold value to see whether or not the vocal tone exceeds the predetermined loudness as by step S702. If the user has not started to sing the song, yet, the music data code expresses only noise, the loudness of which is lower than the threshold value, and the answer at step S702 is given negative "No". Then, the central processing unit 11 proceeds to step S711, and checks the note register to see whether or not the pitch names V and V1 are expressed by "−1". The answer at step S711 is given affirmative "Yes" before the user starts to sing the song.

With the positive answer "Yes" at step S711, the central processing unit 11 immediately returns to step S701. Thus, the central processing unit 11 reiterates the loop consisting of steps S701, S702 and S711 until the answer at step S702 is changed to affirmative.

The user is assumed to start to sing the song. The loudness exceeds the threshold value, and the answer at step S702 is changed to affirmative "Yes". With the positive answer "Yes", the central processing unit 11 determines the pitch of the voice as by step S703. Although the user tries to sing the song expressed by the notes on the music score, the pitch of voice is not always consistent with the pitch of notes. For this reason, the central processing unit 11 compares the pitch of voice with pitch of candidates to see what tone the user wished to pronounce, and determines the pitch name N closest to the pitch of voice as by step S704. The candidates are the pitch names assigned to all of the black and white keys 31*a*/31*b*.

Subsequently, the central processing unit 11 looks up a chord table, which is stored in the read only memory 13, and determines the tones forming a chord together with the tone assigned the pitch name N as by step S705. The pitch name or names of the tones are labeled with "N1".

Subsequently, the central processing unit 11 checks the note register to see whether or not the pitch names N and N1 is identical with the pitch names V and V1 stored in the note register as by step S706. The tones assigned the pitch names V and V1 form the chord, for which the black and white keys 31*a*/33*b* have been already depressed. If the tones have been already produced or will be produced soon at the pitch names N and N1, the pitch names N and N1 were written in the note register as the pitch names V and V1, and the answer at step S706 is given positive "Yes". In this situation, the central processing unit 11 determines the music data code for the vocal note-on event at the pitch name N to be discarded, and immediately returns to step S701.

However, if the tones assigned the pitch names N1 and N1 have not been produced, yet, the answer at step S706 is given negative "No". Subsequently, the central processing unit 11 checks the note register to see whether or not "−1" has been written in the note register as by step S707. When the tone N to be produced is found at the head of the music passage, the answer is given affirmative "Yes". Similarly, when the user enters the transit state between a tone and another tone, the answer at step S707 is also given affirmative "Yes". However, when the user changes the vocal tone to the pitch name N, the previous pitch names V and V1 are stored in the note register, and the answer at step S707 is given negative "No".

The answer at step S707 is assumed to be given affirmative. With the positive answer "Yes", the central processing unit 11 proceeds to step S709. The central processing unit 11 produces the music data codes for the chord, i.e., the tones assigned the pitch names N and N1, and supplies the music data codes to the piano controller 50 through the communication interface 17. The central processing unit determines the key numbers Kn and values of velocity vel on the basis of the pitch names N and loudness, and stores the code expressing the vocal event J(v), code expressing the note-on, key numbers Kn and velocity vel in the data fields FL1, Fl2, FL3 and FL4, respectively. Upon completion of the job at step S709, the central processing unit 11 writes the pitch names N and N1 in the note register as by step S710. Thus, the pitch names of the tones produced through the acoustic piano 30 is registered as the pitch names V and V1.

When the user changes the chord from the pitch names V and V1 to the pitch names N and N1, the answer at step S707 is given negative "No", and the central processing unit 11 produces the music data codes expressing the vocal note-off events for the key 31*a*/31*b* assigned the pitch names V and V1 so as to request the piano controller 50 to decay the tones at the pitches V and V1 as by step 708. The code expressing the vocal event J(v), note-off, key numbers Kn and predetermined velocity vel are stored in the data fields FL1, FL2, FL3 and FL4, respectively. Thereafter, the central processing unit 11 requests the vocal note-on events J(v) for the key 31*a*/31*b* assigned the pitch names N and N1 as by step S709, and rewrites the note register from the pitch names V and V1 to the pitch names N and N1 as by step S710. Upon completion of the job at step S710, the central processing unit 11 returns to step S701.

Thus, while the user is singing the song, the central processing unit 11 reiterates the loop consisting of steps S701 to S710, and sends the music data codes expressing the chords to the piano controller 50.

The user is assumed to enter a rest between the notes on the music score. The loudness is reduced below the threshold value, and the pitch names of the previous chord are found in the note register. In this situation, the answer at step S702 is given negative "No", and the answer at step S711 is also given negative "No". Then, the central processing unit 11 produces the music data code expressing the note-off events for the key 31*a*/31*b* assigned the pitch names V and V1 as by step S712, and sends the music data codes to the piano controller 50 so that the tones at the pitch names V and V1 are decayed.

Subsequently, the central processing unit 11 rewrites the note register from the pitch names V and V1 to −1 as by step S713. As a result, when the user exits from the rest, the central processing unit 11 proceeds to from step S701 to step S709 through the steps S702, 703, S704, S705, S706 and S707, and produces the music data codes expressing the note-on events for the tones assigned the pitch names N and N1.

As will be appreciated from the foregoing description, the voice recognizer produces the music data codes expressing chords on the basis of the vocal tones, and causes the automatic player to accompany the song on the acoustic piano.

Although particular embodiments of the present invention have been shown and described, it will be apparent to those skilled in the art that various changes and modifications may be made without departing from the spirit and scope of the present invention.

The set of music data codes may be loaded into the piano controller from a suitable data source through a public or private communication network. In this instance, the communication network is connected to the communication interface 17.

The note number Kn in the music data code may be spaced from the pitch name N by a "third" or a "fifth". Otherwise, the interval may be specified by the user. The velocity vel for the note-on event J(v) may be adjusted to a value specified by users. On the other hand, the velocity vel for the note-off event J(v) may be varied depending on the loudness.

The silent state may be expressed by another value except for the key numbers Kn assigned to the black and white keys 31*a*/31*b*. In case n is eighty-eight, the silent state may be expressed by 89.

More than two microphones may be prepared for more than two singers. In other words, the number of microphones does not set any limit to the technical scope of the present invention.

The automatic player may produce the tones only at the pitch names identical with those of the vocal tones for the accompaniment.

The chords may be produced together with the tones expressed by the MIDI music data codes.

In the first and second embodiments, the priority may be given to the event arriving at the piano controller earlier than the corresponding event. In this control sequence, if the sequential event J(s) for a black/white key 31*a*/31*b* arrives at the piano controller earlier than the vocal event J(v) for the same key, the tone is produced on the basis of the sequential event J(s). The computer program shown in FIGS. 5A and 5B may be modified for the control sequence as follows. In case where the answer at step S504 is given affirmative "Yes", the central processing unit 11 conducts the jobs same as those at steps S509 and S510, and, thereafter, returns to the main routine program.

The accompaniment may be played on both piano 30 and through the tone generator 19. When a singer does not wish to disturb the neighborhood, he or she changes the hammer stopper 35*a* to the blocking position, and instructs the automatic player 1/1A to accompany the song through the tone generator 19.

The piano controller 50/50A may further drive the pedals PD. For example, if the velocity vel exceeds a threshold, the piano controller PD may depress the damper pedal Pd. On the other hand, if the velocity vel is lower than another threshold, the piano controller PD may depress the soft pedal Ps. Thus, the black and white keys 31*a*/31*b* do not set any limit to the technical scope of the present invention.

The automatic player may be provided for an upright piano. However, the acoustic piano does not set any limit to the technical scope of the present invention. The automatic player may play the accompaniment on another sort of keyboard musical instrument such as, for example, an organ and a harpsichord, a stringed instrument such as, for example, a guitar and a percussion instrument such as, for example, a celesta.

The songs do not set any limit to the technical scope of the present invention. A user may play a piece of music on a musical instrument so as to supply an audio signal representative of the tones produced through the musical instrument.

The component parts of the automatic player piano described in the embodiments are correlated with claim languages as follows.

The acoustic piano tones are corresponding to "internal sound", and the vocal tones are equivalent to "external sound". The acoustic piano 30/30A serve as an "acoustic musical instrument", and the voice recognizer 10/10A are corresponding to a "sound recognizer". The voice signal is corresponding to an "audio signal". The black and white keys 31*a*/31*b* an pedals PD serve as "manipulators", and the solenoid-operated key actuators 59 and solenoid-operated pedal actuators are corresponding to "plural actuators". The piano controller 50/50A serves as a "controller".

The pieces of music data expressing the sequential events J(s) or pieces of music data expressing the voice events J(v) on another microphone are corresponding to "pieces of additional music data". In case where the "pieces of additional music data" serve as the pieces of music data expressing the voice events J(v) on the other microphone, the pieces of music data expressing the sequential events J(s) serve as "pieces of other music data".

The action units 33, hammers 32, strings 34, dampers 36, tone generator 19 and sound system 22 as a whole constitute a "tone generator".

What is claimed is:

1. An automatic player for playing a part of a piece of music on an acoustic musical instrument, comprising:

a sound recognizer analyzing at least pitches of external sound produced by at least one human singer outside of said acoustic musical instrument, determining intended pitches on the basis of said pitches of said external sound, and producing pieces of music data expressing at least pitches of internal sound related to said intended pitches of said external sound and pieces of additional music data expressing at least pitches of said internal sound to be produced together with said internal sound expressed by said pieces of music data, pieces of classification data selectively expressing said pieces of music data and said pieces of additional music data, said pieces of classification data being added to a part of each of said pieces of music data and a part of each of said pieces of additional music data for making it possible to discriminate said each of said pieces of music data from said each of said pieces of additional music data through a difference between a bit string expressing said pieces of music data and another bit string expressing said pieces of additional music data;

plural actuators associated with manipulators of said acoustic musical instrument, and responsive to driving signals so as independently to drive the associated manipulators for producing said internal sound at given pitches without any action of a human player; and a controller connected to said sound recognizer and said plural actuators, supplying said driving signals to the actuators associated with the manipulators to be driven for producing said internal sound at said pitches expressed by said pieces of music data, checking said pieces of classification data to see whether the bit string of said pieces of classification data expresses either music data or additional music data and changing timing to supply said driving signal for producing said internal sound at said pitches expressed by said pieces of additional music data depending upon a result of the check.

2. The automatic player as set forth in claim 1, said pitches of said internal sound are identical with said intended pitches of said external sound.

3. The automatic player as set forth in claim 1, in which said pieces of additional music data are produced on the basis of music data codes selected from a set of music data codes expressing said piece of music.

4. The automatic player as set forth in claim 1, in which selected ones of said pieces of additional music data are discarded before said driving signals are supplied to said actuators if said selected ones of said pieces of additional music data express the pitches identical with the pitches expressed by said pieces of music data for which the associated manipulators have been already driven.

5. The automatic player as set forth in claim 1, in which said pieces of additional music data are produced on the basis of other external sound produced outside of said acoustic musical instrument.

6. The automatic player as set forth in claim 5, in which said sound recognizer further produces pieces of other music data expressing at least the pitches of said internal sound so that said controller further supplies said driving signals to the actuators associated with the manipulators to be driven for producing said internal sound at the pitches expressed by said pieces of other music data.

7. The automatic player as set forth in claim 6, in which said pieces of other music data are produced on the basis of music data codes selected from a set of music data codes expressing said piece of music.

8. The automatic player as set forth in claim 1, in which said pitches of said internal sound are spaced from said intended pitches of said external sound by a predetermined interval or predetermined intervals.

9. The automatic player as set forth in claim 1, in which said pitches of said internal sound are partially identical with said intended pitches of said external sound and partially spaced from said intended pitches by predetermined intervals.

10. The automatic player as set forth in claim 1, in which said external sound contains vocal tones sung by another human singer.

11. The automatic player as set forth in claim 10, in which said plural actuators selectively drive said manipulator to accompany said human singer on said acoustic musical instrument.

12. An automatic player musical instrument for playing at least a part of a piece of music, comprising:

an acoustic musical instrument including:

manipulators driven for specifying pitches of internal sound, and a tone generator connected to said manipulators and producing said internal sound at said pitched specified through said manipulators; and an automatic player provided in association with said acoustic musical instrument, and including a sound recognizer analyzing at least pitches of external sound produced by at least one human singer outside of said acoustic musical instrument, determining intended pitches on the basis of said pitches of said external sound and producing pieces of music data expressing at least pitches of said internal sound related to said intended pitches and pieces of additional music data expressing at least pitches of said internal sound to be produced together with said internal sound expressed by said pieces of music data for playing said piece of music, pieces of classification data selectively expressing said pieces of music data and said pieces of additional music data, said pieces of classification data being added to a part of each of said pieces of music data and a part of each of said pieces of additional music data for making it possible to discriminate said each of said pieces of music data from said each of said pieces of additional music data through a difference between a bit string expressing said pieces of music data and another bit string expressing said pieces of additional music data, plural actuators associated with said manipulators and responsive to driving signals so as independently to move the associated manipulators, thereby causing said tone generator to produce said internal sound without any action of a human player, and a controller connected to said sound recognizer and said plural actuators, selectively supplying said driving signals to said plural actuators associated with the manipulators to be driven for producing said internal sound at said pitches expressed by said pieces of music data, checking said pieces of classification data to see whether the bit string of said pieces of classification data expresses either music data or additional music data and changing the timing to supply said driving signal for producing said internal sound at said pitches expressed by said pieces of additional music data depending upon a result of the check.

13. The automatic player musical instrument as set forth in claim 12, in which said tone generator produces said internal sound through vibrations of strings which said plural actuators selectively give rise to through the motion of said manipulators.

14. The automatic player musical instrument as set forth in claim 13, in which said tone generator and said manipulators form parts of an acoustic piano serving as said acoustic musical instrument.

15. The automatic player musical instrument as set forth in claim 12, in which said pieces of additional music data are produced on the basis of music data codes selected from a set of music data codes expressing said piece of music.

16. The automatic player musical instrument as set forth in claim 12, in which selected ones of said pieces of additional music data are discarded before said driving signals are supplied to said actuators if said selected ones of said pieces of additional music data express the pitches identical with the pitches expressed by said pieces of music data for which the associated manipulators have been already driven.

17. The automatic player musical instrument as set forth in claim 12, in which said pieces of additional music data are produced on the basis of other external sound produced outside of said acoustic musical instrument.

18. The automatic player musical instrument as set forth in claim 12, in which said pitches of said internal sound are spaced from said intended pitches of said external sound by predetermined intervals.

* * * * *